US005886601A

United States Patent [19]

Kitamura et al.

[11] Patent Number: 5,886,601

[45] Date of Patent: Mar. 23, 1999

[54] ELECTROMAGNETIC RELAY ASSEMBLY

[75] Inventors: Nobuhiro Kitamura, Katano; Hiroaki Hamaguchi, Nagoya; Naoki Kanemoto, Tsu; Masahiro Kutsuna, Ichishi; Tetsuyasu Kawamoto, Moriguchi, all of Japan

[73] Assignee: Matsushita Electric Works, Ltd., Osaka-fu, Japan

[21] Appl. No.: 901,201

[22] Filed: Jul. 28, 1997

[30] Foreign Application Priority Data

Feb. 6, 1997 [JP] Japan ..... 9-023959

[51] Int. Cl.[6] ..... H01H 67/02

[52] U.S. Cl. ..... 335/129; 335/78; 335/128; 335/130; 335/131; 335/132

[58] Field of Search ..... 335/129, 128, 335/78–86, 130–132

[56] References Cited

U.S. PATENT DOCUMENTS

| | | | |
|---|---|---|---|
| 4,345,225 | 8/1982 | Lemmer | 335/132 |
| 4,893,102 | 1/1990 | Bauer | 335/132 |
| 5,359,305 | 10/1994 | Kitamura et al. | 335/78 |
| 5,389,905 | 2/1995 | Shibata et al. | 335/78 |

FOREIGN PATENT DOCUMENTS

| | | |
|---|---|---|
| 488891 | 6/1992 | European Pat. Off. . |
| 2284332 | 11/1990 | Japan . |
| 4195188 | 7/1992 | Japan . |
| 6-76717 | 3/1994 | Japan . |
| 81797926 | 7/1996 | Japan . |
| 9-63444 | 3/1997 | Japan . |

OTHER PUBLICATIONS

An English Language abstract of JP 2–284332.
An English Language abstract of JP 8–179726.
English Language Abstract Japanese Patent No. 6–76717.
English Language Abstract of Japanese Patent No. 9–63444.

*Primary Examiner*—M. L. Gellner
*Assistant Examiner*—Tuyen T. Nguyen
*Attorney, Agent, or Firm*—Greenblum & Bernstein, P.L.C.

[57] ABSTRACT

An electromagnetic relay assembly includes an actuator unit and at least one switch unit detachably connected with the actuator unit. The actuator unit includes an actuator casing accommodating therein an electromagnetic assembly and a movable actuator frame magnetically attracted by the electromagnetic assembly to move between first and second positions. The switch unit Includes a switch casing accommodating therein a switch assembly capable of selectively assuming one of an ON state in response to movement of the movable actuator frame from the first position to the second position and an OFF position in response to movement of the movable actuator frame from the second position to the first position. The actuator casing and the switch casing have mating engagement members by which the actuator unit and the switch unit can be separably connected together while the movable actuator frame in the actuator unit can be drivingly coupled with the switch assembly In the switch unit.

20 Claims, 15 Drawing Sheets

10
63
63a
64
64a
65
65a
66
66a
67
68
69
71
72
76
76a
78
80
81
82
83
84
84a
84b
84c
85
86
106
114
115
116
117

Fig.16A
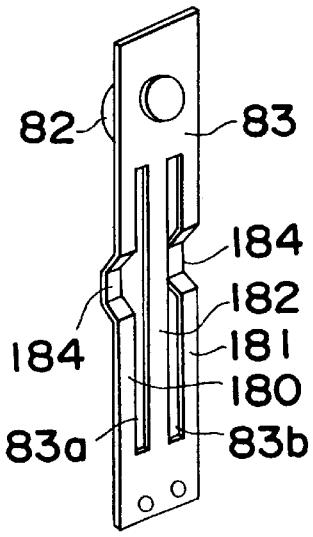
Fig.16B
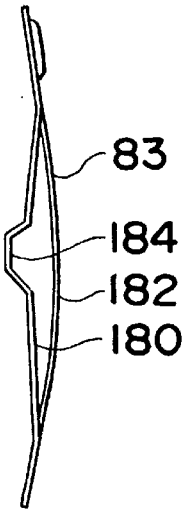
Fig.17
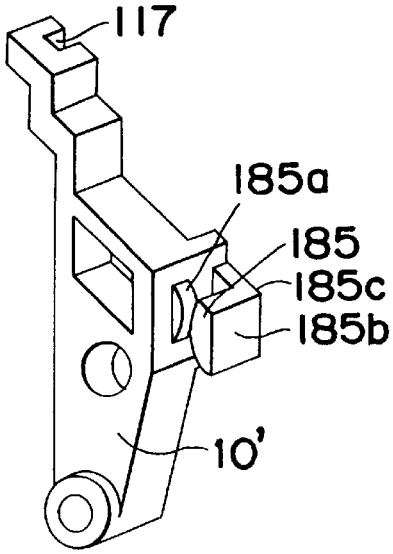
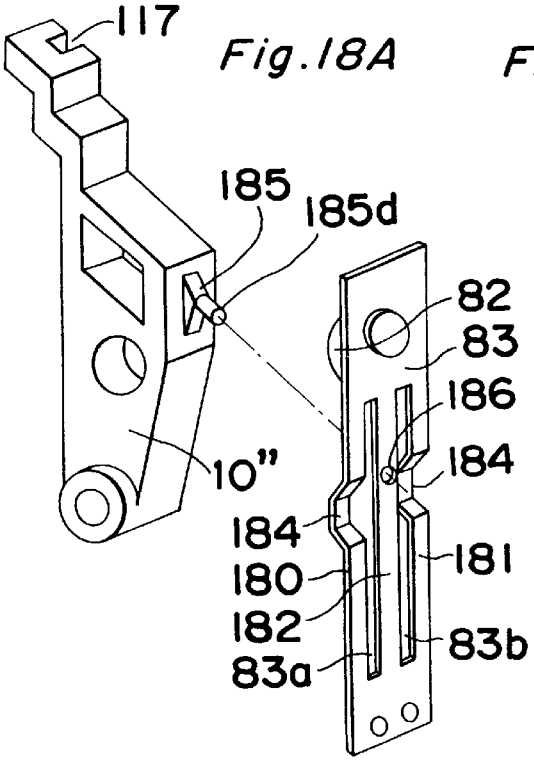
Fig.18A
Fig.18B
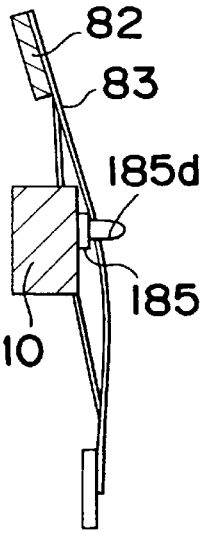
Fig.18C
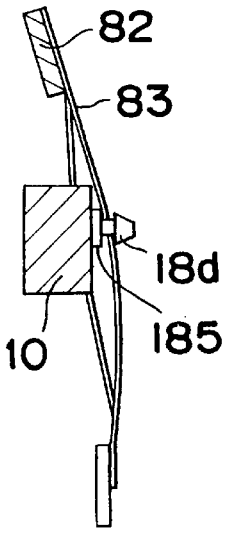

ELECTROMAGNETIC RELAY ASSEMBLY

BACKGROUND OF THE INVENTION

1. Field of the Invention

The present invention relates generally to an electromagnetic relay assembly and, more particularly, to the electromagnetic relay assembly of a type comprising an electromagnetic unit and at least one switch unit operatively coupled with and controlled by the electromagnetic unit.

2. Description of the Prior Art

The Japanese Laid-open Patent Publication No. 6-76717, published Mar. 18, 1994, discloses an electromagnetic relay assembly for selectively opening and closing an electric circuit including a load such as, for example, a capacitor or a lamp in which a relatively high inrush current flows when the circuit is established. This prior art electromagnetic relay assembly comprises a single casing accommodating therein an electromagnetic assembly, a movable actuator frame magnetically attracted by the electromagnetic assembly to move between first and second positions, and a switch assembly including a main switch and a sub-switch both driven by the movable actuator frame to selectively open and close an electric circuit.

Considering that the single-pole switch and the double-pole switch are generally of different sizes and require different switching mechanisms, the above mentioned prior art publication which discloses the use of the single casing for accommodating all necessary component parts that make up not only the actuator unit, but also the switch unit suggests the necessity of manufacturing two separate types of electromagnetic relay assembly; one type employing the movable actuator frame designed for exclusive use in the single-pole switch system and the other type employing the movable actuator frame designed for exclusive use in the double-pole switch system.

Thus, according to the prior art, the actuator unit cannot be commonly used with any one of the single-pole and double-pole switch systems and, consequently, manufacture of the two separate types involves an increase in cost of the resultant products. Moreover, since the double-pole type is rather complicated in structure, assemblage thereof is time-consuming.

Also, considering that the driving point of a driving piece or card used to selectively engaging and disengaging contacts together and from each other, respectively, differs in position depending on whether the switch is a single-pole switch or whether the switch is a double-pole switch, and therefore, the contacts in the single-pole switch and the contacts in the double-pole switch are driven at different speeds, there may arise problem associated with the difference in contact bounce time and driving time.

Also, in the prior art electromagnetic relay assembly, since the main switch and the sub-switch are accommodated in the same space within the single casing, carbon particles produced as a result of repeated switching of the main switch may be deposited, accompanied by reduction in contact reliability. Change of use of the sub-switch requires change of the casing and the movable actuator frame. In addition, since the yoke of the electromagnetic assembly is fixed on the bottom wall of the casing, the electromagnetic assembly tends to be often installed in an inclined fashion, resulting in failure to operate properly and deterioration in characteristic.

Moreover, in the prior art electromagnetic relay assembly, the relationship between the displacement of the movable actuator frame and the displacement of the switch contact Is determined by the ratio of leverage between the axis about which the movable actuator frame displaces and the center of the electromagnetic assembly and the position at which the driving piece or card is driven, there is no freedom of design choice of the main and auxiliary switches of the switch assembly.

Furthermore, in the prior art electromagnetic relay assembly, the electromagnetic assembly including the yoke and the coil bobbin is fixed in position inside the casing by the use of a heat-curable bonding material. Accordingly, depending on the temperature of heat used to cure the bonding material, change in characteristic tends to occur considerably and, also, during the bonding process, the damper used to provide a cushioning effect to the movement of the movable actuator frame tends to be displaced in position.

SUMMARY OF THE INVENTION

Accordingly, the present invention has been devised to eliminate the above discussed problems and inconveniences inherent in the prior art electromagnetic relay assembly and is intended to provide an improved electromagnetic relay assembly wherein the electromagnetic assembly and the switch assembly are accommodated in respective spaces separate from each other to minimize the possible deposit of carbon particles to thereby increase the reliability.

Another Important object of the present invention is to provide an improved electromagnetic relay assembly of the type referred to above, wherein a single actuator unit can be employed for driving one or more switch units which may have the same or different switch specifications.

A further Important object of the present invention is to provide an improved electromagnetic relay assembly of the type referred to above, wherein regardless of whether the switch assembly is a single-pole switch or whether the switch assembly is a double-pole switch, the same or substantially same switching speed can be obtained.

Other important objects of the present invention includes to facilitate an easy coupling of the actuator unit with one or more of the switching units, to accomplish a stabilized operating characteristic of the electromagnetic relay assembly, to avoid a possible displacement in position of the damper, and to provide a freedom of design choice in switch specification.

In order to accomplish these and other objects of the present invention, a broad aspect of the present invention provides an electromagnetic relay assembly includes an actuator unit and at least one switch unit separably connected with the actuator unit. The actuator unit includes an actuator casing accommodating therein an electromagnetic assembly and a movable actuator frame magnetically attracted by the electromagnetic assembly to move between first and second positions,. The switch unit Includes a switch casing accommodating therein a switch assembly capable of selectively assuming one of an ON state in response to movement of the movable actuator frame from the first position to the second position and an OFF position in response to movement of the movable actuator frame from the second position to the first position. Means are included in part in the actuator casing and in part in the switch casing for detachably connecting the actuator unit and the switch unit together and also for drivingly coupling the movable actuator frame with the switch assembly.

According to the present invention, assuming that the switch assembly in one switch unit is a single-pole switch, a double-pole switch can be obtained when two switch units are coupled with each other and are in turn drivingly coupled with the actuator unit. The number of the switch units that can be drivingly coupled with the actuator unit may not be thus limited to one and two or more switch units can be employed with the single actuator unit. In such case, the plural switch units may be coupled with each other substantially In a stacked fashion and the actuator unit is then drivingly coupled with one of the stacked switch units which is closest to the actuator unit.

According to another aspect of the present invention, the actuator frame may include first and second actuator rods protruding therefrom in a direction counter to the electromagnetic assembly and, on the other hand, the driving piece has first and second engagements with which the first and second actuator rods are engageable, respectively. In such case, the switch assembly may comprise a main switch capable of being switched on and off when the second actuator rod is engaged with and disengaged from the second engagement, respectively, and an auxiliary switch capable of being switched off and on when the first actuator rod is disengaged from and engaged with the second engagement, respectively. Preferably, the timing at which the main switch is switched on is delayed a predetermined time from the timing at which the auxiliary switch is switched on and the timing at which the auxiliary switch is switched off is delayed a predetermined time from the timing at which the main switch is switched off.

Preferably, the main switch has main movable and fixed contacts engageable with each other and the auxiliary switch has auxiliary movable and fixed contacts engageable with each other. The main movable and fixed contacts and the auxiliary movable and fixed contacts may be disposed parallel to each other in an electric circuit of the switch assembly. At least one of the auxiliary movable and fixed contacts of the auxiliary switch is preferably made of a metallic material having a high melting point such as tungsten added with 1 to 80 wt % of an additive selected from the group consisting of Ag, C, Cu, In and Cd, to avoid a possible contact fusion.

According to a further aspect of the present invention, a reversible bistable leaf spring may be employed to support the auxiliary movable contact. This bistable leaf spring can be selectively displaced to one of first and second reversible states whereby when the switch assembly is to be closed, the bistable leaf spring is displaced to the first reversible state to bring the auxiliary movable contact to engage the auxiliary fixed contact and then back to the second reversible state to separate the auxiliary movable contact from the auxiliary fixed contact after the main movable contact has been engaged with the main fixed contact, but when the switch assembly is to be opened, the bistable leaf spring is displaced to the second reversible state subsequent to the main movable contact having been separated from the main fixed contact.

In a preferred embodiment of the present invention herein disclosed, the switch assembly in the switch unit comprises the main and auxiliary switches. However, the switch assembly is used as a single-pole switch since while the main switch is used to accomplish a primary switching function the auxiliary switch Is utilized to minimize generation of arcs which tend to occur between contacts of the main switch particularly where a relatively high inrush current flows to the load to be controlled. However, in a broad sense of the present invention, such auxiliary switch is not always essential and may therefore be dispensed with together with its related component parts or may be used for a different purpose, for example, for selectively opening and closing an electric circuit different from that controlled by the main switch.

BRIEF DESCRIPTION OF THE DRAWINGS

The present invention will become readily understood from the following description of preferred embodiments thereof made with reference to the accompanying drawings, in which like parts are designated by like reference numeral and in which:

FIG. 16A is a perspective view, on an enlarged scale, showing an auxiliary leaf spring employed in the switch unit shown in FIG. 15;

FIG. 16B is a side view of the auxiliary leaf spring shown in FIG. 16A;

FIG. 17 is a perspective view, on an enlarged scale, showing a modified driving piece which can be employed in the switch unit in combination with the auxiliary leaf spring shown in FIGS. 16A and 16B;

FIG. 18A is a perspective view of a further modified form of the driving piece shown together with a modified form of the auxiliary leaf spring;

FIGS. 18B and 18C are side sectional view of the further modified driving piece showing how the modified auxiliary leaf spring shown in FIG. 18A is fitted to the further modified driving piece shown in FIG. 18A;

Figure 1A:
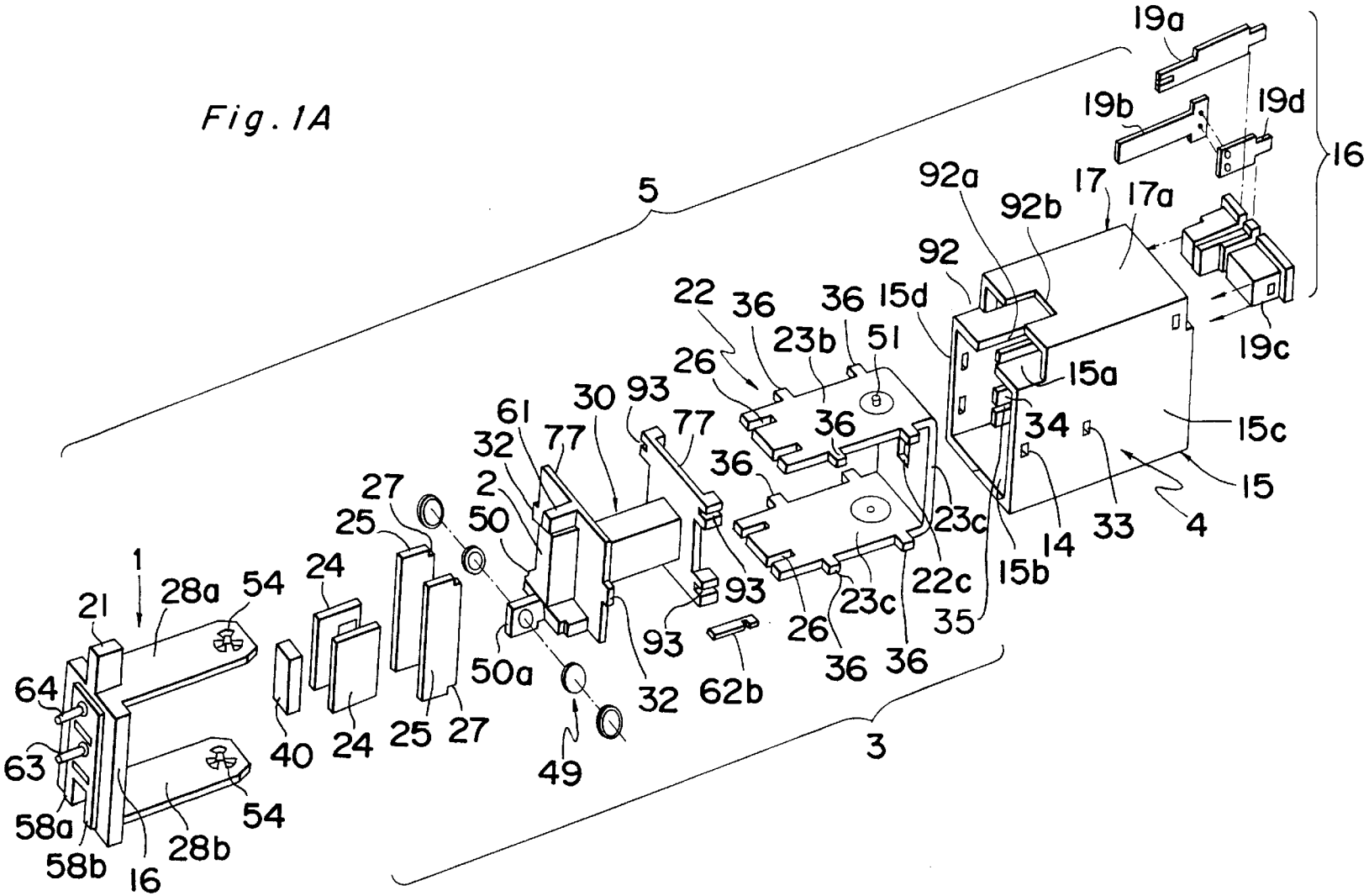
FIG. 1A is an exploded view of an actuator unit which forms a part of the electromagnetic relay assembly according to the present invention.

DETAILED DESCRIPTION OF THE EMBODIMENTS (First Embodiment—FIGS. 1A to 14)

Referring first to FIGS. 1A to 4B, an electromagnetic relay assembly according to a first preferred embodiment of the present invention comprises an actuator unit 5 and at least one switch unit 8 separate from, but operatively coupled with and controlled by the electromagnetic unit 5. The actuator unit 5 comprises, as best shown in FIG. 1A and FIGS. 3A to 3D, an actuator casing 4. The actuator casing 4 is of a resin-molded one-piece structure including a main box 15 and an auxiliary actuator box 17 positioned atop the main box 15 and accommodates therein an electromagnetic assembly 3 and a generally U-shaped actuator frame 1 made of a synthetic resin.

The main box 15 has top and bottom walls 15*a* and 15*b*, opposite side walls 15*c* and 15*d* and a rear wall 15*e* all assembled together to render the main box 15 to represent a generally rectangular box-like configuration. Thus, the main box 15 opens at one end in a direction away from the rear wall 15*e* thereof where a plurality of, for example, four, terminal bearing holes 37 are formed at respective locations inwardly adjacent four corners of the rearwall 15*e*. It is to be noted that, as will become clear from the subsequent description, three of the terminal bearing holes 37 are utilized.

On the other hand, the auxiliary box 17 positioned atop the main box 15 is of a generally inverted U-shaped cross-section including a top wall 17*a*, spaced upwardly from the top wall 15*a* of the main box 16 so as to define a monitor switch chamber in cooperation with the top wall 15*a* as will be described later, and opposite side walls which are integral parts of the respective side walls 15*c* and 15*d* of the main box 15. By the reason which will become clear later, the top wall 17*a* of the auxiliary box 17 is so undersized relative to the top wall 15*a* of the main box 15 as to define a generally L-shaped cutout space 92 substantially above the open end of the main box 15 for accommodating a manipulatable switching lever 21.

Figure 1B:
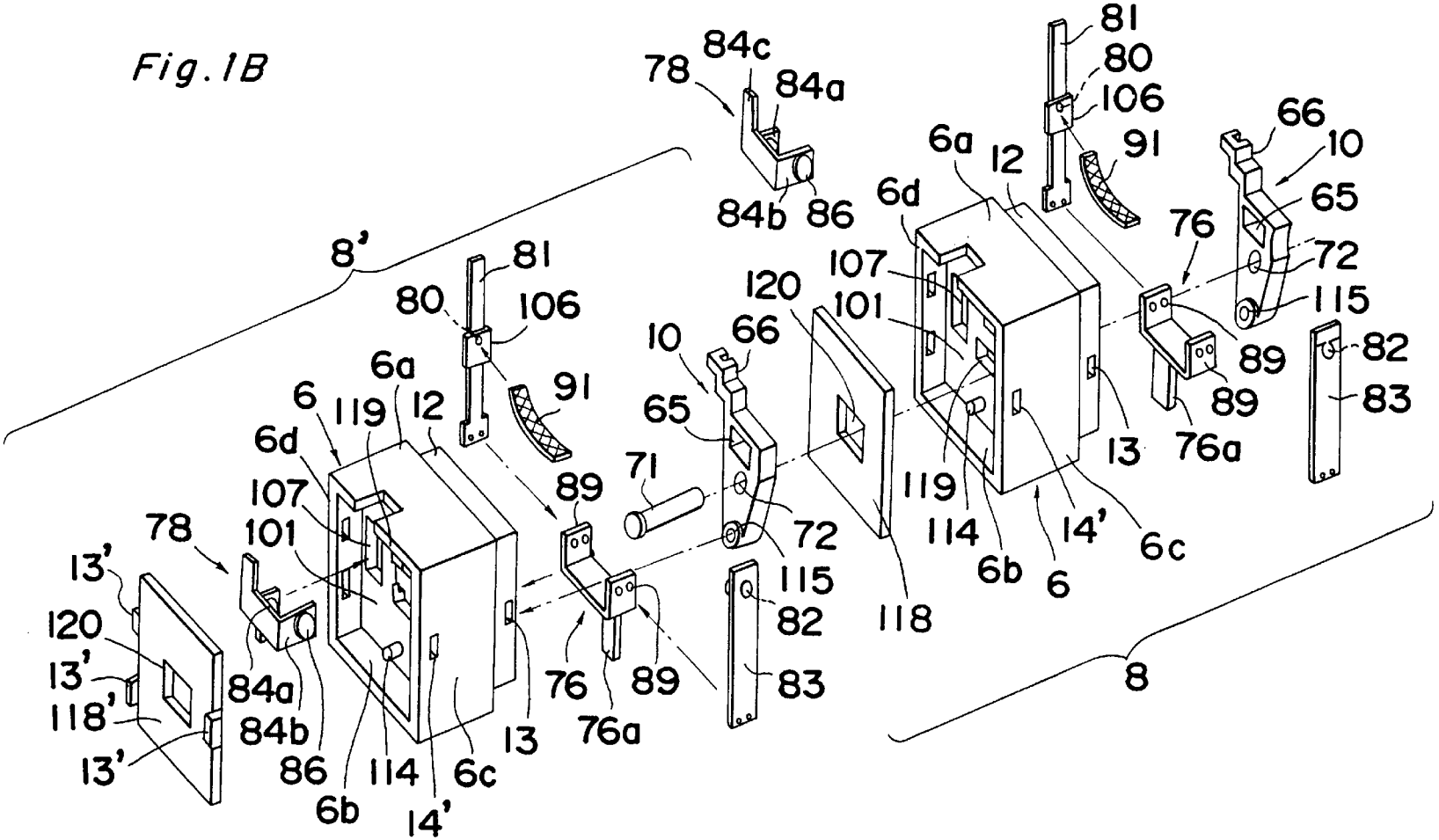
FIG. 1B is an exploded view of switch units according to a first preferred embodiment of the present invention, which form other parts of the electromagnetic relay assembly and which can be drivingly coupled with the actuator unit shown FIG. 1A.
Figure 2:
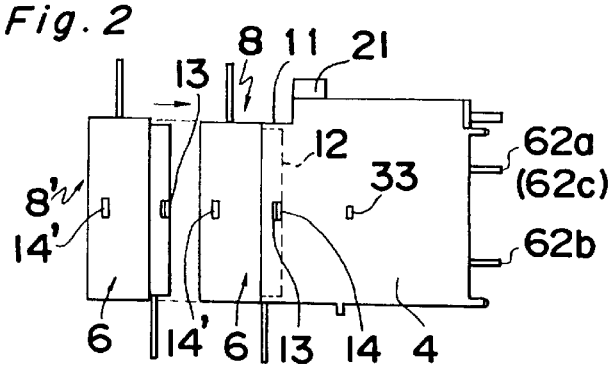
FIG. 2 is a side view showing the manner in which the actuator unit shown in FIG. 1A and the switch units shown in FIG. 1B are mechanically coupled with each other.

As shown in FIGS. 1B, 2, 4A and 4B, the switch unit 8, although two switch units 8 and 8' of an identical construction are shown in FIGS. 1B and 2, comprises a switch casing 6 of a resin-molded one-piece structure including top and bottom walls 6*a* and 6*b*, opposite side walls 6*c* and 6*d* and an intermediate partition wall 101, all assembled together to render the switch casing 6 to represent a generally rectangular box-like configuration, and a switch assembly 7. The intermediate partition wall 101 divides the interior of the switch casing 6 into front and rear chambers, the rear chamber being communicated with the interior of the main box 15 of the actuator casing 4 when the switch unit 8 is coupled with the actuator unit 5 in a manner which will be described later.

In order for the switch unit 8 to be consistently coupled with the actuator unit 5, one of opposite open ends of-the switch casing 6 which confronts the actuator unit 5 has a wall thickness reduced at 12 to define a four-sided plug-in flange which is, when the switch unit 8 is coupled with the actuator unit 5, snugly received within the open end of the main box 15 of the actuator casing 4 with the top, bottom and side walls of the switch casing 6 having their outer surfaces held in flush with corresponding outer surfaces of the top, bottom and side walls of the main box 15.

Although once the switch unit 8 is coupled with the actuator unit 5 the plug-in flange 12 may be glued to the open end of the main box 15 for substantially permanent connection if so desired, one of important features of the present invention lies in that the actuator unit 5 can be selectively coupled with one of the plural switch units 8 and 8' which may have the same or different switch specifications as will be described later, or can be coupled with and be used for controlling the plural switch units 8 and 8' which may have the same or different switch specifications. Accordingly, the actuator and switch casings 4 and 6 has respective releasable interconnecting means which may comprise a plurality of pawls 13 formed in one of the actuator and switch casings 4 and 6 and a corresponding number of detent holes 14 formed in the other of the actuator and switch casings 4 and 6. In the illustrated embodiment, the three pawls 13 are formed in the plug-in flange 12 of the switch casing 6, one in a side wall of the plug-in flange 12 continued from the side wall 6*c* and the other two in the side wall of the plug-in flange 12 continued from the opposite side wall 6*d*, whereas the detent holes 14 are defined in the walls of the main box 15 of the actuator casing 4 adjacent the open end thereof at such locations that when as shown in FIG. 2 the switch unit 8 is coupled with the actuator unit 5 with the plug-in flange 12 fitted into the open end of the main box 15, the pawls 13 can be snapped into the corresponding detent holes 14.

It is to be noted that the use of at least one pawl 13 in combination with the mating detent hole 14 may be sufficient to accomplish a releasable connection between the actuator and switch units 4 and 8.

As will become clear from the subsequent description, the switch casing 8 has similar detent holes 14' defined In the opposite side walls of the switch casing 6 in a pattern similar to the detent holes 14 In the actuator casing 4 so that another switch unit 8 can be coupled in a plug-in fashion with the switch unit 8 which is, or may subsequently be, coupled with the actuator unit 5 substantially as shown in FIG. 2.

From the description made so far, it will readily be understood that the actuator unit 5 can be operatively coupled with one or a series of the switch units 8 and 8'.

Figure 3A:
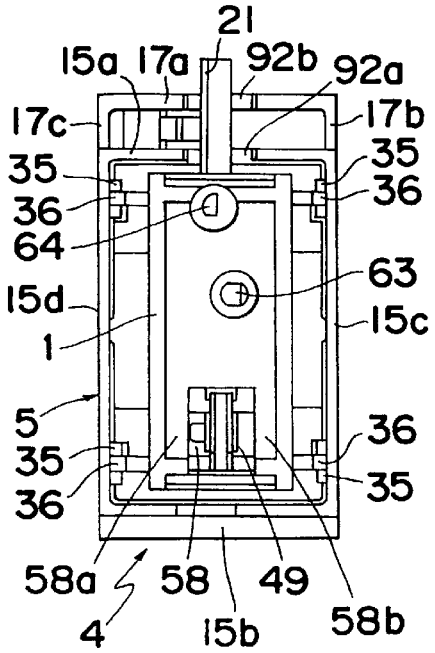
FIG. 3A is a front elevational view, on an enlarged scale, of the actuator unit shown FIG. 1A.

As best shown in FIGS. 1A and 3A, the opposite side walls 15*c* and 15*d* of the main box 15 of the actuator casing 4 have upper and lower guide grooves 35 each delimited between guide bars 34 secured to Inner surfaces of the side walls 15*c* and 15*d*, the function of each of said guide grooves 35 being described later. The opposite side walls 15*c* and 15*d* of the main box 16 are formed with respective catch holes 33 positioned generally intermediate of the length of the actuator casing 4 and also with a generally U-shaped cutout 92*a* defined in the top wall 15*a* so as to extend a distance from a front edge thereof in a direction inwardly towards the rear wall 15*c*. The top wall 17*a* of the auxiliary box 17 is formed with a generally U-shaped cutout 92*b* so as to extend a distance, smaller than the distance of extension of the U-shaped cutout 92*a*, from a front edge thereof in a direction inwardly towards the rear wall 15*c* in alignment with the U-shaped cutout 92*a*. The function of each of the cutouts 92*a* and 92*b* in the respective top walls 15*a* and 17*a* will become clear from the subsequent description.

The electromagnetic assembly 3 comprises, as shown in FIGS. 1A, 3A, 3B and 5 to 7, a coil bobbin 30, an iron core 2 inserted in the coil bobbin 30, a yoke 22, generally rectangular pole pieces 24, a generally rectangular permanent magnet 40 firmly secured to the pole piece 24 in the form as sandwiched between front edges of the respective pole pieces 24 and a damper 49. The yoke 22 includes a generally U-shaped main yoke 23 comprised of a yoke base 23*a*, top and bottom yoke arms 23*b* and 23*c* lying perpendicular to the yoke base 23*a*, and generally rectangular side yokes 25 having respective magnetic pole faces confronting the associated pole pieces 24. The yoke 22 has a bearing hole 22*c* defined in the yoke base 23*a* for receiving a rear end of the iron core 2 when the coil bobbin 30 carrying the iron core 2 and an electromagnetic coil 94 (FIG. 3B) formed therearound is inserted In between the top and bottom yoke arms 23*b* and 23*c*.

Each of the top and bottom yoke arms 23*b* and 23*c* is formed with a plurality of, for example, two, guide wings 36 protruding laterally outwardly from opposite side edges thereof. Accordingly, as the electromagnetic assembly 3 is inserted into the main box 15 of the actuator casing 4 with the yoke base 23*a* confronting the rear wall 15*e*, the guide wings 36 integral with the top yoke arm 23*b* and the guide wings 36 integral with the bottom yoke arm 23*c* can be slidingly guided in and along the upper and lower guide grooves 35, respectively. As hereinbefore described, each of the guide grooves 35 is defined by the guide bars 34 secured to the inner surface of the associated side wall 15*c* or 15*d* of the main box 15.

Cylindrical bearing pins 51 are formed on the top and bottom yoke arms 23*b* and 23*c* so as to protrude coaxially in a direction away from each other and are positioned at respective locations adjacent the yoke base 23*a*. The bearing pins 51 are used to pivotally support the U-shaped actuator frame 1 in a manner which will now be described. Each of the top and bottom yoke arms 23*b* and 23*c* has a free end opposite to the yoke base 23*a* where two spaced bearing recesses 26 are formed so as to extend inwardly thereof. The side yokes 25 each having positioning recesses formed at 27 are, after the coil assembly including the electromagnetic coil 94 wound around the iron core 2 through the coil bobbin 30 has been received by the U-shaped main yoke 23, that is, in a space delimited by the yoke base 23*a* and the top and bottom yoke arms 23*b* and 23*c*, mounted to the main yoke 23 with their opposite ends snugly fitted into the bearing recesses 26 while the positioning recesses 27 in those side yokes 25 receive respective bottoms of the bearing recesses 26 to keep the top and bottom yoke arms 23*b* and 23*c* apart from each other. Thus, in an assembled condition of the electromagnetic assembly 3, each of the side yokes 25 lies in a plane perpendicular to the yoke base 23*a* and also to each of the top and bottom yoke arms 23*b* and 23*c*.

The coil bobbin 30 made of any suitable synthetic resin known to those skilled in the art and Is formed at its opposite ends with a generally, rectangular front or rear flange 77. The iron core 2 is of a generally T-shape having a longitudinal body and a transverse body and is inserted in the coil bobbin 30 with the transverse body thereof positioned outside the front bobbin flanges 77 adjacent the U-shaped actuator frame 1, by the use of any known insert-molding technique during the manufacture of the coil bobbin 30. In the assembled condition, that rear end of the longitudinal body of the iron core 2 opposite to the transverse body thereof protrudes a slight distance outwardly from the rear bobbin flanges 77 so that when the electromagnetic assembly 3 is assembled, that rear end of the longitudinal body of the iron core 2 can be snugly received in the bearing hole 22*c* in the yoke base 23*a*.

Figure 3B:
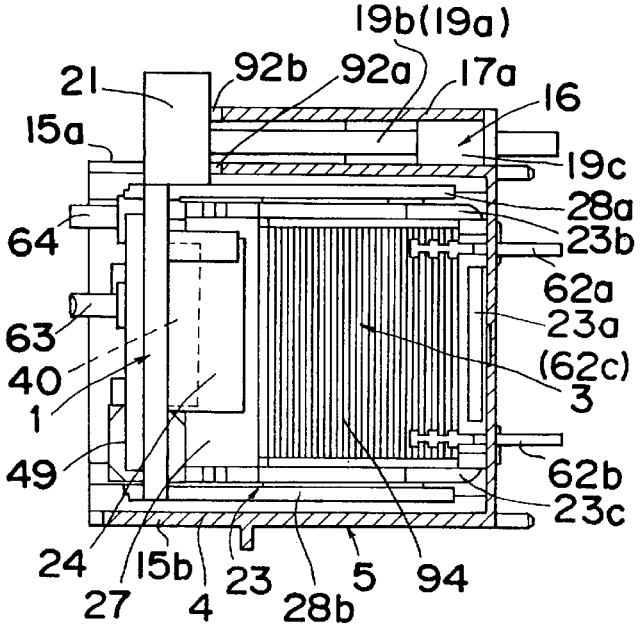
FIG. 3B is a side sectional view of the actuator unit.

As best shown in FIGS. 1A and 3B, the rear bobbin flange 77 adjacent the rear end of the longitudinal body of the iron core 2 has its four corners formed with bearing recesses 93 for receiving corresponding terminal pins 62*a*, 62*b* and 62*c*. Although in the illustrated embodiment the four bearing recesses 93 are employed in the rear bobbin flange 77, the number of the terminal pins 62*a*, 62*b* and 62*c* is three and these terminal pins 62*a* to 62*c* are used to connect the electromagnetic coil 94 with an external electrical circuit. In the assembled condition of the actuator unit 5, these terminal pins 62*a* to 62*c* firmly received in the respective bearing recesses 93 in the rear bobbin flange 77 extends outwardly through the corresponding terminal bearing holes 37 defined in the rear wall 15*e* of the main box 15 as can be seen from FIGS. 3B and 3D. It is to be noted that the terminal pins 62*a* to 62*c* although in the illustrated embodiment snugly fitted in the associated bearing recesses 93 may be insert-molded in the rear bobbin flange 77 during the insert-molding of the coil bobbin 30.

Although not shown, the electromagnetic coil 94 in the illustrated embodiment includes two coil windings wound around the coil bobbin 30 in a sense opposite to each other with the terminal pin 62*a* connected in common to those coil windings. The other ends of those coil windings remote from the terminal pin 62*a* are connected respectively with the terminal pins 62*b* and 62*c*.

To secure the electromagnetic assembly 3 in position within the main box 15 of the actuator casing 4, the front bobbin flange 77 adjacent the transverse body of the iron core 2 has laterally protruding anchor protuberances 32 formed integrally with respective side edges thereof so as to protrude outwardly in a direction away from each other. When the electromagnetic assembly 3 is inserted into the main box 15 of the actuator casing 4 as shown in FIG. 3B, the anchor protuberances 32 integral with the front bobbin flange 77 are snapped into the associated catch holes 33 defined in the side walls 15*c* and 15*d* of the main box 15.

The damper 49 is carried by the front bobbin flange 77 so as to protrude outwardly therefrom towards the U-shaped actuator frame 1 in the manner which will now be described. As shown in FIG. 1A, the front bobbin flange 77 is integrally formed with forward projections 61 adjacent top and bottom edges thereof. The forward projections 61 are spaced a distance sufficient to accommodate the transverse body of the iron core 2 therebetween. One of the forward projections 61 integral with the front bobbin flange 77 adjacent the bottom edge thereof is in the form of a generally rectangular block and serves as a bench 50 for the support of the damper 49. To use one of the forward projections 61 integral with the front bobbin flange 77 and, hence, the coil bobbin 30 as the bench 50 for the support of the damper 49 is particularly advantageous in that not only can the damper 49 be accurately positioned and accomplish a satisfactory damping function relative to the U-shaped actuator frame 1 as will be described later, but it can also be easily assembled together with the coil bobbin 30.

Alternatively, the bench 50 for the support of the damper 49 may be an integral part of the transverse body of the iron core 2.

Figure 5:
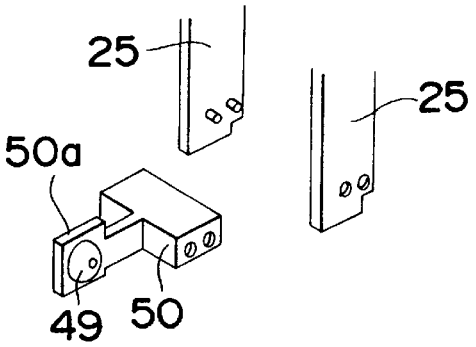
FIG. 5 is a schematic exploded view of a damper and a support bench therefor which are employed in the actuator unit.
Figure 6:
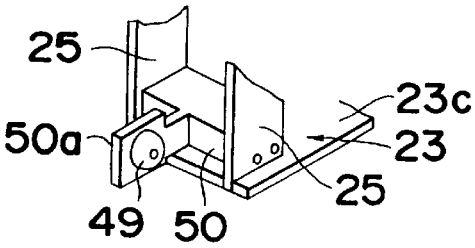
FIG. 6 is a fragmentary perspective view of the damper in an assembled condition in the actuator unit.

Again alternatively, the bench 50 may be a member separate from the coil bobbin 30 and may, as shown in FIGS. 5 and 6, be secured to the side yokes 25 In a fashion sandwiched therebetween by means of set screws (not shown). In any event, by the reason which will become clear from the subsequent description, the bench 50 for the support of the damper 49 and, hence, the damper 49 itself, is stationary relative to the U-shaped actuator frame 1.

The bench 50 has a generally intermediate portion formed with a plate-like arm 50*a* extending outwardly therefrom in a direction away from the coil bobbin 30 and having a bearing hole in which the damper 49 is fixedly received. Although the damper disclosed in the previously discussed prior art publication may be employed in the present invention, the damper 49 is in the form of an elastic ball made of an elastic material and having a perforated partition wall dividing the interior of the ball into first and second semispherical chambers which are communicated with each other through the perforation in the partition wall. The ball is filled with a viscous fluid such as, for example, silicone oil. This damper 49 is mounted in the bearing hole in the bench arm 50*a* with the first and second semispherical chambers positioned on respective sides of the bench arm 50*a* so that when the actuator frame 1 collides against, for example, the first semispherical chamber as will be described later, the first semispherical chamber is compressed to allow a portion of the viscous fluid within the first semispherical chamber to flow into the second semispherical chamber through the perforation in the partition wall, thereby providing a damping effect to the movement of the actuator frame 1.

With particular reference to FIGS. 1A, 3A and 3B, the detail of the U-shaped actuator frame 1 will now be described. As shown therein, the U-shaped actuator frame 1 is of a generally U-shaped configuration comprising a generally rectangular body 1*b* and upper and lower actuator arms 28*a* and 28*b* formed integrally with opposite ends of the actuator body 1*b* so as to extend therefrom in the same direction towards the coil bobbin 30. The actuator arms 28*a* and 28*b* have bearing holes 54 formed in respective free ends thereof for pivotal engagement with the associated bearing pins 51 on the yoke arms 23*b* and 23*c* and are therefore spaced from each other a distance corresponding to the distance between the yoke arms 23*b* and 23*c*.

The bearing hole 54 in each of the actuator arms 28*a* and 28*b* may be a mere round hole. However, in the illustrated embodiment, to minimize a friction, each bearing hole 54 is delimited by a plurality of, for example, three, radially inwardly protruding lobes to provide a three-point contact between the associated actuator arm 28*a* or 28*b* and the bearing hole 54.

The actuator body 1*b* has its rear surface inwardly recessed at 44 (FIG. 7) to receive the assembly of the permanent magnet 40 and the pole pieces 24 with a front surface of the permanent magnet 40 glued by the use of a bonding material to the bottom of the recess in the actuator body 1*b*. The actuator frame 1 is mounted on the electromagnetic assembly 3 with the bearing pins 61 rotatably engaged in the respective bearing holes 54. In this assembled condition, the permanent magnet 40 has its rear face confronting the transverse body of the iron core 2 and the pole pieces 24 are situated between the side yokes 25 while lying parallel thereto.

The manipulatable switching lever 21 referred to previously is integrally formed with an upper end of the actuator body 1*b* so as to extend upwardly therefrom. The actuator body 1*b* has its front surface formed with first and second actuating rods 63 and 64 protruding forwards therefrom in a direction opposite to the actuator arms 28*a* and 28*b* and extending parallel to each other, the function of each of said actuating rods 63 and 64 being described later. The actuator body 1*b* is also formed with a recess 58 cut inwardly from a lower end thereof so as to leave on respective sides of the recess 58 actuator legs 58*a* and 58*b* which are selectively brought into contact with the first and second semispherical chambers of the damper 49, respectively, as will be described later.

To mount the U-shaped actuator frame 1 on the electromagnetic assembly 3 and, particularly, the U-shaped main yoke 23 with the bearing pins 51 extending through the associated bearing holes 54 so that the actuator frame 1 can be pivotable between left and right about a common axis connecting the bearing pins 51 together, the actuator arms 28*a* and 28*b* have to be forcibly expanded outwardly from each other to allow the bearing pins 51 to be received within the associated bearing holes 54. If this appears to be cumbersome, the U-shaped actuator frame 1 may be modified as shown in FIG. 7.

Figure 7:
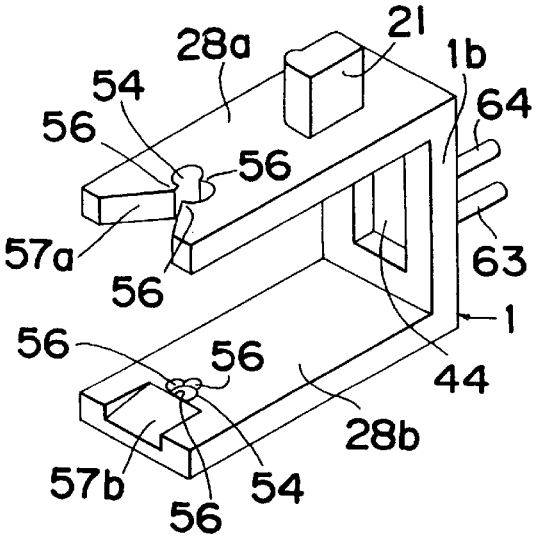
FIG. 7 is a schematic perspective view, on an enlarged scale, showing a modified form of an actuator frame used in the actuator unit.

Referring to FIG. 7, the upper actuator arm 28*a* is cut inwardly from the free end thereof to define a generally V-shaped guide walls 57*a* that converge towards the bearing hole 54. The bottom of the V-shape assumed by the guide walls 57*a* is spaced from each other a distance smaller than the diameter of the associated bearing pin 51, but of a size sufficient to allow the bearing pin 51 to be forcibly past therethrough. The three lobes delimiting the bearing hole 54 in the upper actuator arm 28*a* are generally indicated by 56, two of which are represented by innermost edges of the V-shaped guide walls 57*a*. On the other hand, the lower actuator arm 28 has a guide slope 57*b* defined at the free end thereof so as to extend upwardly therefrom towards the bearing hole 54.

According to the modified form of the actuator frame 1 shown in FIG. 7, application of a pushing force is sufficient to allow the modified actuator frame to be mounted on the electromagnetic assembly 3. However, in place of a combination of the V-shaped guide walls 57*a* and the guide slope 57*b*, the V-shaped guide walls 57*a* may be formed in both of the actuator arms 28*a* and 28*b* or the guide slope 27*b* may be formed in both of the actuator arms 28*a* and 28*b*.

The electromagnetic assembly 3, Including the coil bobbin 30, the iron core 2, the yoke 22 and the damper 49, and the actuator frame 1 pivotally mounted on the U-shaped main yoke 23 are encased within the main box 15 as best shown in FIG. 3B with the guide wings 36 guided in and along the guide grooves 35 until the anchor protuberances 32 integral with the front bobbin flange 77 are snapped into the associated catch holes 33 in the side walls 15*c* and 15*d* of the main box 15, thereby completing the actuator unit 5. In the condition shown in FIG. 3B, the first and second actuator rods 63 and 64 integral with the actuator body 1*b* protrudes a predetermined distance outwardly from a plane of the front opening of the main box 15; the manipulatable switching lever 21 is situated within the L-shaped cutout space 92 and loosely extends upwardly through the U-shaped cutout 92*a* in the top wall 15*a* of the main box 15 and then through the U-shaped cutout 92*b* in the top wall 17*a* of the auxiliary box 17; and the terminal pins 62*a* to 62*c* extends outwardly of the main box 15 through the respective terminal bearing holes 37 in the rear wall 15*e* of the main box 15.

It is to be noted that although each of the guide grooves 35 may have a groove width substantially equal to the thickness of the wall forming the U-shaped main yoke 23, the groove width of each of the guide grooves 35 of the upper pair is preferably chosen to be slightly greater than the thickness of the wall forming the U-shaped main yoke 23 so that the U-shaped main yoke 23 having a slightly varying distance between the yoke arms 23*b* and 23*c* can satisfactorily be inserted into the main box 15 or so that variation in distance between the yoke arms 23*b* and 23*c* of the U-shaped main yokes can be compensated for.

The actuator unit 5 of the structure described above is so designed and so configured that when an electric current flowing in one direction is supplied to the coil winding between the terminal pins 62*a* and 62*b* or when an electric current flowing in the opposite direction is supplied to the coil winding between the terminal pins 62*a* and 62*c,* the U-shaped actuator frame 1 can be pivoted to the left or to the right, respectively, as viewed in FIG. 3A by the effect of magnetism between the pole pieces 24 and the side yokes 25. Thus, the U-shaped actuator frame 1 can have one of the two operative positions depending on the direction of flow of the electric current through the electromagnetic assembly 3.

Figure 3C:
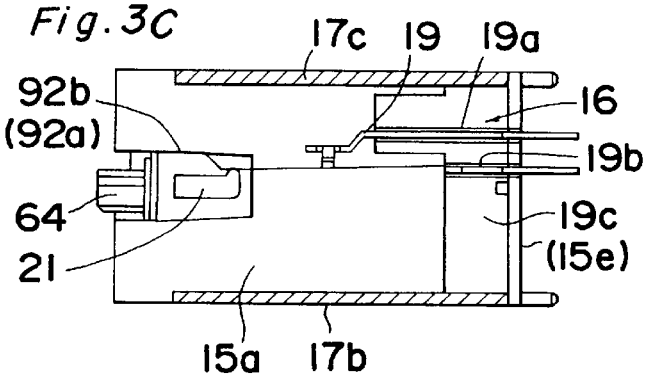
FIG. 3C is a top sectional view of the actuator unit.
Figure 3D:
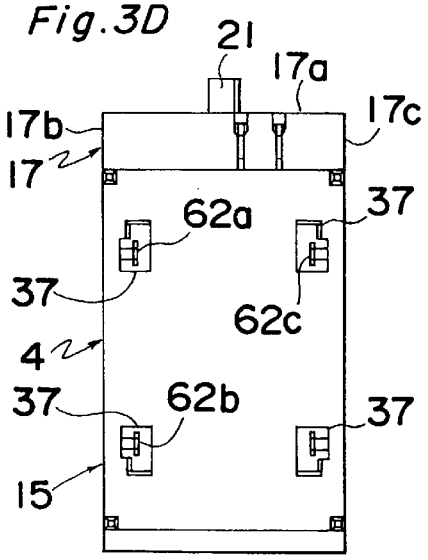
FIG. 3D is a rear view of the actuator unit.

Referring still to FIGS. 1A, 3B and 3C, a monitor switch 16 for electrically detecting the position of the U-shaped actuator frame 1 relative to the electromagnetic assembly 3 is encased within the auxiliary box 17 of the actuator casing 4. This monitor switch 16 includes a fixed contact member 19*a* having a fixed contact made of an electroconductive material, for example, a silver alloy, and fixedly mounted on a generally rectangular carrier block 19*c,* and an elastically yieldable movable contact member 19*b* mounted on the carrier block 19*c* through a carrier plate 19*d* so as to extend substantially parallel to the fixed contact member 19*a*. Although not shown, the movable contact member 19*b* has a movable contact that is selectively engageable or disengageable with or from the fixed contact on the fixed contact member 19*a*.

The carrier block 19*c* carrying the fixed and movable contact members 19*a* and 19*b* concurrently serves as a closure for closing one of the opposite open ends of the auxiliary box 17 adjacent the rear wall 15*e* of the main box. For this purpose, the carrier block 19*c* is fixedly inserted in the auxiliary box 17 to close that open end of the auxiliary box 17 with the fixed and movable contact members 19*a* and 19*b* positioned inside the auxiliary box 17 as bet shown in FIG. 3B. The movable contact member 19*b* has a length greater than the fixed contact member 19*a* and has a free end engageable with the manipulatable switching lever 21 so that when the manipulatable switching lever 21 and, hence, the U-shaped actuator frame 1 is pivoted to one of the two positions, for example, to the left as viewed in FIG. 3A, the movable contact member 19*b* can be deformed against its own resiliency to contact the fixed contact member 19*a* to thereby complete a circuit of the monitor switch 16.

As will be discussed later, the monitor switch 16 is selectively opened or closed In response to selective opening or closure of the switch assembly 7 in the switch unit 8 or each of the switch units 8 and 8' and, accordingly, the use of the monitor switch 16 although not essential in the practice of the present invention enables the electromagnetic relay assembly of the present invention to be usable in a remote-controlled monitoring system.

The details of the switch unit 8 will now be described with particular reference to FIGS. 1B, 2, 4A and 4B. As briefly described, the two switch units 8 and 8' are shown in FIGS. 1B and 2, but they are of an identical construction, except for a motion transmitting rod 71 used to drivingly connect the switch units 8 and 8' together, and therefore reference will be made to only one of the switch units, that is, the switch unit 8 in describing the structure and the function thereof.

The switch unit 8 comprises the switch assembly 7. This switch assembly 7 includes a movable contact terminal 76 and a fixed contact terminal 78, both of which may be made of a rigid electroconductive material. The movable contact terminal 76 is of a generally U-shaped configuration including a base and two upstanding arms 89 and has a terminal extension 76*a* extending downwardly from the base of the movable contact terminal 76. A main leaf spring 81 having a movable contact 80 and an auxiliary leaf spring 83 having an arc contact 82 are fixedly mounted on the respective arms 89 of the movable contact terminal 76 so as to extend upwardly in a direction counter to the terminal extension 76*b*. The movable contact terminal 76 carrying the leaf springs 81 and 83 is fixedly housed within the rear chamber of the switch casing 6 with the terminal extension 76*a* protruding outwardly from the rear chamber of the switch casing 6 through the bottom wall 6*b* thereof while the leaf springs 81 and 83 extend generally along and adjacent the side walls 6*d* and 6*c,* respectively. This disposition of the movable contact terminal 76 carrying the leaf springs 81 and 83 is particularly advantageous to allow the switch contact members to be snugly positioned in a limited available space within the switch casing 6.

It is to be noted that in order for the switch unit 8 to be effectively utilized In a high-voltage, high-current environment, the movable contact 80 on the main leaf spring 81 is backed up by an electroconductive plate piece 106 which is positioned on one side of the main leaf spring 81 opposite to the movable contact 80, but is rigidly connected with the movable contact 80 and which is additionally electrically connected with the movable contact terminal 76 by means of a braided or mesh-like conductor 91 having its opposite ends soldered respectively to the electroconductive plate piece 106 and the base of the movable contact terminal 76.

With the movable contact terminal 76 accommodated within the rear chamber of the switch casing 6 together with the leaf springs 81 and 83, the movable contact 80 on the main leaf spring 81 and the arc contact 82 on the auxiliary leaf spring 83 are oriented so as to face the side wall 6*d* of the switch casing 6.

The fixed contact terminal 78 is of a generally U-shaped configuration including a base and two transverse arms 84*a* and 84*b* perpendicular to the base and has a terminal extension 84*c* extending upwardly from the base of the fixed contact terminal 78 in a direction substantially perpendicular to any one of the transverse arms 84*a* and 84*b*. This fixed contact terminal 78 is fixedly accommodated within the front chamber of the switch casing 6 as shown in FIG. 4B. In this condition, the transverse arms 84*a* and 84*b* protrude into the rear chamber of the switch casing 6 through respective holes 107 defined in the intermediate partition wall 101 and the terminal extension 84*c* extends outwardly from the front chamber of the switch casing 6 through the top wall 6*a* of the switch casing 6 as shown in FIG. 4B. With the fixed contact terminal 78 so positioned inside the front chamber of the transverse arms 84*a* and 84*b* are so positioned as to confront the movable and arc contacts 80 and 82, respectively, within the rear chamber of the switch casing 6.

Figure 4A:
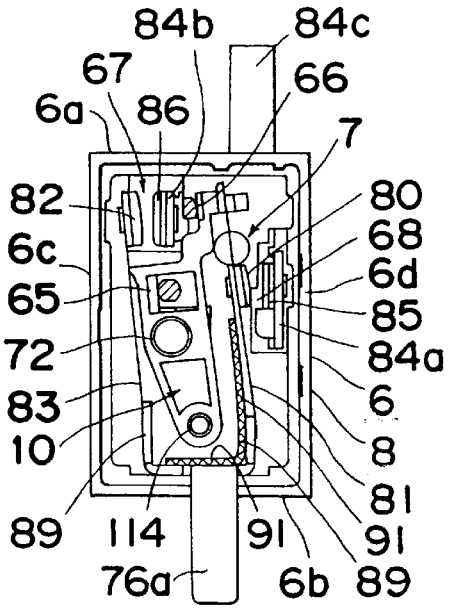
FIG. 4A is a front elevational view, on an enlarged scale, of one of the switch units shown in FIG. 1B.
Figure 4B:
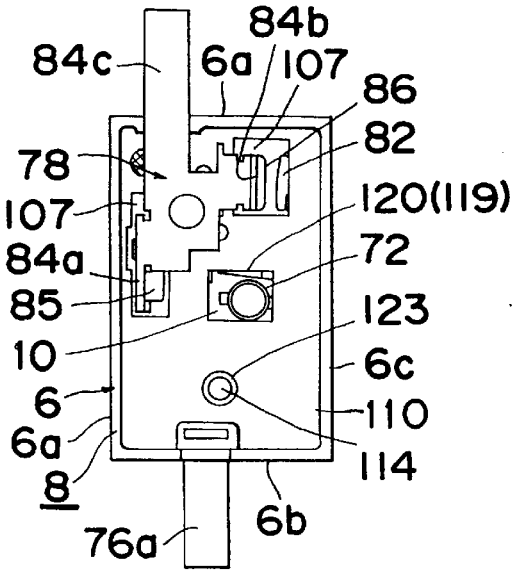
FIG. 4B is a rear view of the switch unit shown in FIG. 4A.

As best shown in FIG. 4A, the transverse arms 84*a* and 84*b* of the fixed contact terminal 78 have respective fixed contacts 85 and 86 fixedly mounted thereon. In the assembled condition with the transverse arms 84*a* and 84*b* positioned inside the rear chamber of the switch casing 6, the fixed contacts 85 and 85 on the transverse arms 84*a* and 84*b* are held in face-to-face relation with the movable and arc contacts 80 and 82, respectively.

It is to be noted that the arc contact 82 and the mating fixed contact 86 form an auxiliary or arc switch 67 and are each made of a fusion-resistant electroconductive material having a high melting point such as, for example, tungsten. In the practice of the present invention, however, the use of tungsten added with 1 to 80 wt % of an additive such as Ag, C, Cu, In or Cd or a mixture thereof Is preferred as material for each of the contacts 82 and 86 forming the auxiliary or arc switch 67. It is also to be noted that the movable contact 80 and the mating fixed contact 85 form a main switch 68 and are each made of an electroconductive material having a good performance in contact resistance brought about when the both are held in contact with each other.

The switch unit 8 also comprises a generally elongated driving piece 10 having a bearing hole 115 defined in a lower end thereof. This driving piece 10 is pivotally mounted within the front chamber of the switch casing 6 with the bearing hole 115 receiving therein a pivot pin 114 formed integrally with the intermediate partition wall 101 at a position adjacent the bottom wall 6*b* so as to protrude perpendicular thereto. This driving piece 10 has a first engagement 65 defined therein in the form of a generally rectangular engagement hole for loosely receiving therein the first actuator rod 63 integral with the actuator frame 1 when the switch unit 8 is coupled with the actuator unit 5. This driving piece 10 Is formed with a connecting hole 72 defined therein at a location substantially below the first engagement 65 for receiving the motion transmitting rod 71 as will be described later, and also with a second engagement 66 employed in the form of a stepped pawl extending slantwise upwardly from an upper end of the driving piece 10 and engageable with the second actuator rod 64.

If desired, the pivot pin 114 and the associated bearing hole 115 in the driving piece 10 may be so designed and so configured that once the pivot pin 114 is passed through the bearing hole 115, the driving piece 10 will no longer be detachable from the pivot pin 114. This can be accomplished by using the pivot pin 114 in the form of, for example, a tubular member having at a free end thereof an axially split conical head of a type which radially inwardly yields as it passes through the bearing hole 115, but will radially outwardly expands upon completion of passage through the bearing hole 115.

When the plug-in flange 12 of the switch casing 6 is received within the front open end of the main box 15 with the pawls 13 snapped into the associated detent holes 14 to thereby complete a firm coupling between the switch unit 8 and the actuator unit 5 substantially as shown in FIG. 2, the first actuator rod 63 is drivingly, but loosely engaged with the first engagement 65 in the driving piece 10.

In the illustrated embodiment, the arc switch 67 is so designed as to be switched from an ON position to an OFF position when the first actuator rod 63 integral with the U-shaped actuator frame 1 acts on the first engagement 65, but to assume the ON position when the first actuator rod 63 no longer acts on the first engagement 65. On the other hand, the main switch 68 is so designed as to be switched from an OFF position to an ON position when the second actuator rod 64 also integral with the actuator frame 1 acts on the second engagement 66, but to assume the OFF position when the second actuator rod 64 no longer acts on the second engagement 66. In addition, the timing at which the main switch 68 switched from the OFF position to the ON position is delayed relative to the timing at which the arc switch 67 is switched from the OFF position to the ON position and, also, the timing at which the arc switch 67 is switched from the ON position to the OFF position is delayed relative to the timing at which the main switch 68 is switched from the ON position to the OFF position.

Summarizing the foregoing, the U-shaped actuator frame 1 can be pivoted about the common axis connecting between the bearing pins 51 in one direction when the electromagnetic assembly 3 is energized with the electric current flowing in a first direction through the electromagnetic coil 94 to magnetically attract the pole pieces 24 to pole faces of the iron core 2 and the side yokes 25, but in the opposite direction when the electromagnetic assembly 3 is energized with the electric current flowing in a second direction, opposite to the first direction, through the electromagnetic coil 94 to magnetically attract the pole pieces 24 to the pole faces of the iron core 2 and the side yokes 25. When the U-shaped actuator frame 1 is so pivoted, the pivotal movement of the actuator frame 1 is transmitted to the driving piece 10 to drive the switch assembly 7 and also to the monitor switch 16.

Hereinafter, the manners in which the electromagnetic relay assembly of the structure described hereinabove is set and reset will be described with reference to FIGS. 8A to 9 and FIGS. 10A to 11, respectively.

Figures 8A, 8B, 8C:
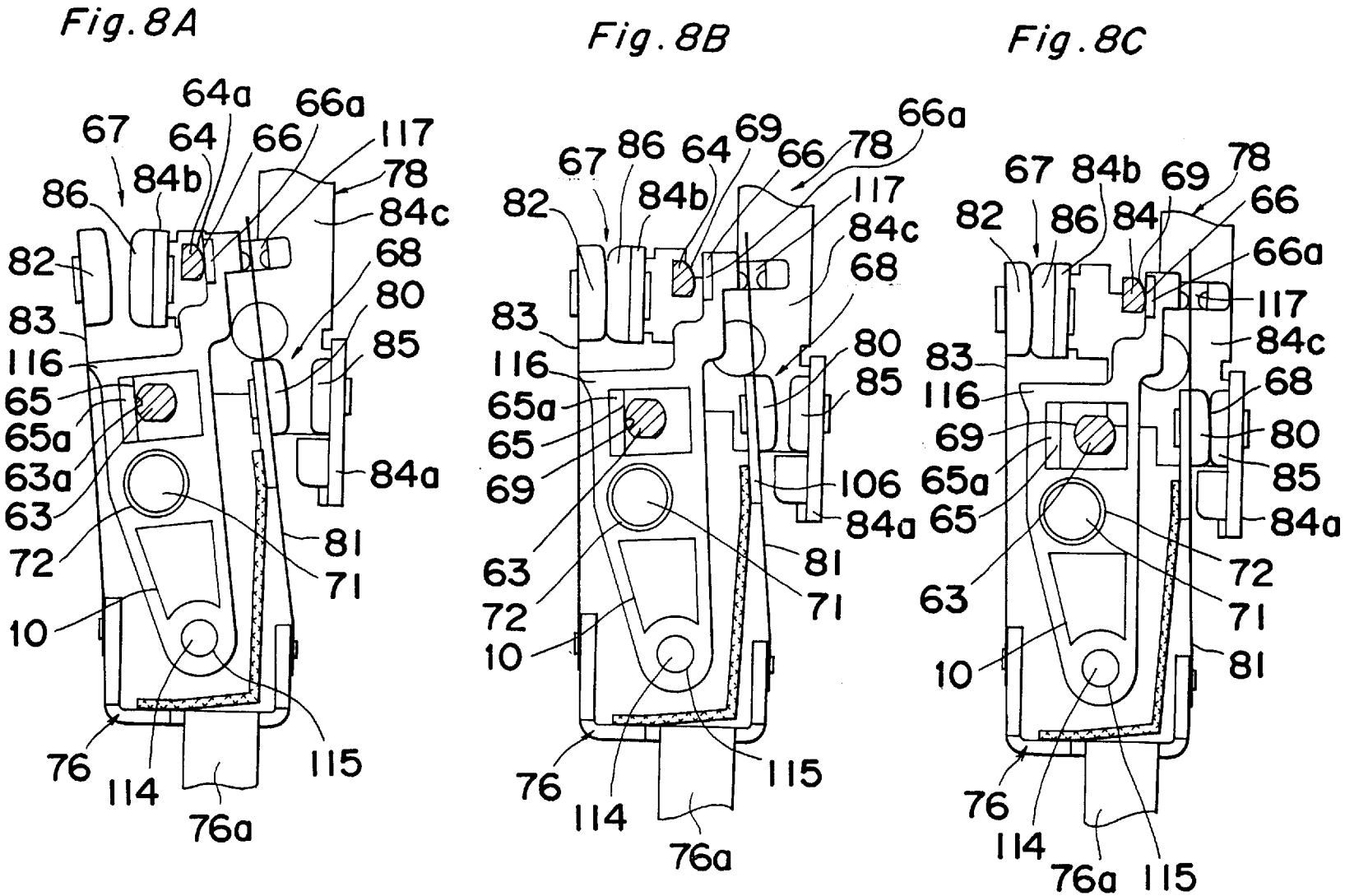
FIGS. 8A to 8C are schematic front elevational views of the switch unit showing the sequence of operation thereof during a setting of the electromagnetic relay assembly.

Referring first to the set operation of the electromagnetic relay assembly, FIG. 8A illustrates both of the arc switch 67 and the main switch 68 being held in the OFF position. Specifically, the U-shaped actuator frame 1 is pivoted to the left as viewed in FIG. 3A with the first engagement 65 in the driving piece 10 consequently pushed by the first actuator rod 63 to pivot the driving piece 10 counterclockwise about the pivot pin 114. In this condition, a shoulder 116 at the upper end of the driving piece 10 is held in contact with the auxiliary leaf spring 83 to urge the latter against its own resiliency with the arc contact 82 consequently disengaged from the mating fixed contact 86. On the other hand, the second actuator rod 64 is at this time disengaged from and, hence, no longer acts on the second engagement 66 and, therefore, the movable contact 80 is disengaged from the mating fixed contact 85 by the effect of the resiliency of the main leaf spring 81. Thus, in this condition shown in FIG. 8A, the arc contact 82 is disengaged from the mating fixed contact 86, thereby causing the arc switch 67 to assume the OFF position, and the movable contact 80 of the main switch 68 is disengaged from the mating fixed contact 85 thereby causing the main switch 68 to assume the OFF position.

As the U-shaped actuator frame 1 is pivoted towards the right, accompanied by a rightward movement of the first actuator rod 63 as viewed in FIG. 8B, the pushing force having been applied to the driving piece 10 through the first actuator rod 63 is no longer active, allowing the auxiliary leaf spring 83 to restore to the original shape by the effect of the resiliency of the auxiliary leaf spring 83 with the arc contact 82 consequently brought into contact with the mating fixed contact 86 to switch the arc switch 67 on. This condition takes place when the actuator frame 1 and, hence, the driving piece 10 being pivoted towards the right arrives at a transit position substantially intermediate between the left and right positions of the actuator frame 1, during which the second actuator rod 64 integral with the actuator frame 1 has not bet been engaged with the second engagement 66 integral with the driving piece 10 and the movable contact 80, although having been moved a slight distance towards the mating fixed contact 85 as a result of the pivotal movement of the driving piece 10 in a clockwise direction as biased by the auxiliary leaf spring 83, has not yet been engaged with the mating fixed contact 85 with the main switch 68 consequently held in the OFF position.

Continued pivotal movement of the actuator frame 1 and, hence, the driving piece 10 to the right results in the second actuator rod 64 to push the second engagement 66 integral with the driving piece 10 to cause the latter to further pivot clockwise. This further clockwise pivot of the driving piece 10 brings the movable contact 80 into engagement with the mating fixed contact 85 against the resiliency of the main leaf spring 81 to thereby switch the main switch 68 on substantially as shown in FIG. 8C. This is possible because a free end of the main leaf spring 81 remote from the movable contact terminal 76 is secured to, or otherwise gripped at 117 by the driving piece 10 for movement together therewith. Upon arrival of the actuator frame 2 at the right position and, hence, upon completion of the clockwise pivot of the driving piece 10 as shown in FIG. 8C, not only is the main switch 68 held firmly in the ON position, but the first actuator rod 63 integral with the actuator frame 1 does no longer apply a pushing force to the first engagement 65 in the driving piece 10 with the shoulder 116 separated from the auxiliary leaf spring 83, allowing the arc and mating fixed contacts 82 and 86 to be kept in contact with each other, i.e., allowing the arc switch 67 to be kept in the ON position.

It is to be noted that since the actuator frame 1 is magnetically driven between the left and right positions, the driving piece 10 is no way of being held standstill at the transit position and will move instantaneously past the transit position. However, reference has been made to the transit position for the driving piece 10 to show the presence of a time lag in operation between the arc and main switches 67 and 68 as will become more clear from the subsequent description. Briefly speaking, during the set operation of the electromagnetic relay assembly of the present invention, the arc switch 67 is first switched on and the main switch 68 is subsequently switched on as described above, but during a reset operation thereof, the arc switch 67 is switched off after the main switch 68 has been switched off as will be described subsequently.

Figure 9:
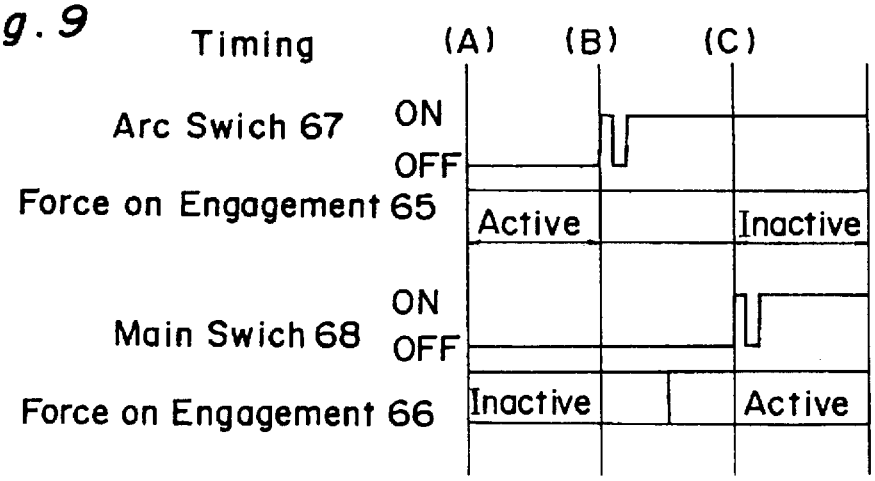
FIG. 9 is a timing chart showing the timings at which arc and main switches in the switch unit are operated in relation to pushing forces applied from the actuator unit during the set operation of the electromagnetic relay assembly.

FIG. 9 illustrates a timing chart showing the timings at which the arc and main switches 67 and 68 are operated In relation to the pushing forces applied from the first and second actuator rods 63 and 64 to the first and second engagements 65 and 66, respectively, during the set operation of the electromagnetic relay assembly. In this timing chart of FIG. 9, legends (A), (B) and (C) used in connection with the timing correspond respectively to the conditions of FIGS. 8A, 8B and 8C.

From FIGS. 8A to 8C and FIG. 9, it is clear that during the set operation of the electromagnetic relay assembly according to the first embodiment of the present invention, a predetermined time after the arc switch 67 having an excellent resistance to contact fusion is switched on, the main switch 68 having an excellent performance in contact resistance is switched on. Accordingly, the possibility of the main switch 68 being damaged which would be brought about by the inrush current flowing therethrough can advantageously be reduced and, hence, the possibility of the movable and mating fixed contacts 80 and 85 being fused together can be minimized.

As briefly described previously, during the reset operation thereof, the arc switch 67 is switched off after the main switch 68 has been switched off as will be described subsequently. This reset operation will now be described with particular reference to FIGS. 10A to 10C in combination with the corresponding timing chart shown in FIG. 11. It is to be noted that since the reset operation is an operation substantially reverse to the set operation, i.e., to bring the arc and main switches 67 and 68 to the OFF positions, the condition shown In FIG. 10A and the condition shown in FIG. 10C are identical with that shown in FIG. 8C and that shown in FIG. 8A, respectively.

Figure 10C:
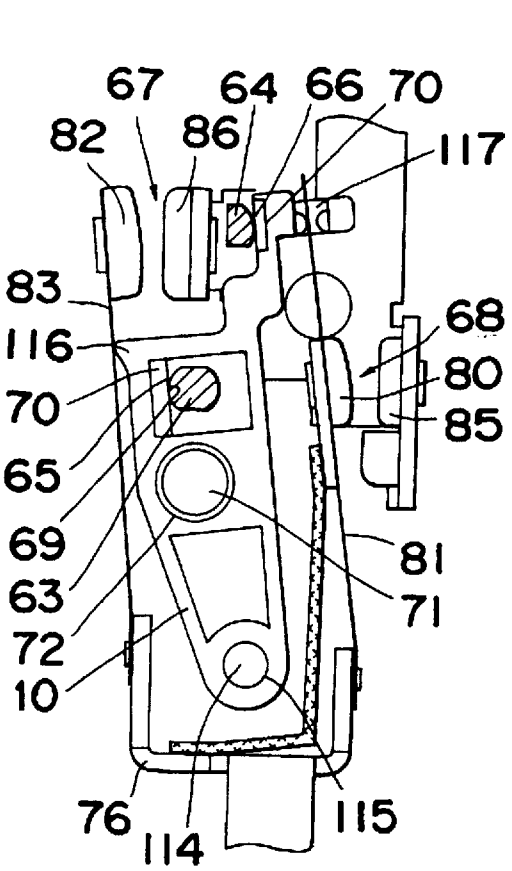
FIGS. 10A to 10C are schematic front elevational views of the switch unit showing the sequence of operation thereof during a resetting of the electromagnetic relay assembly.
Figure 10B:
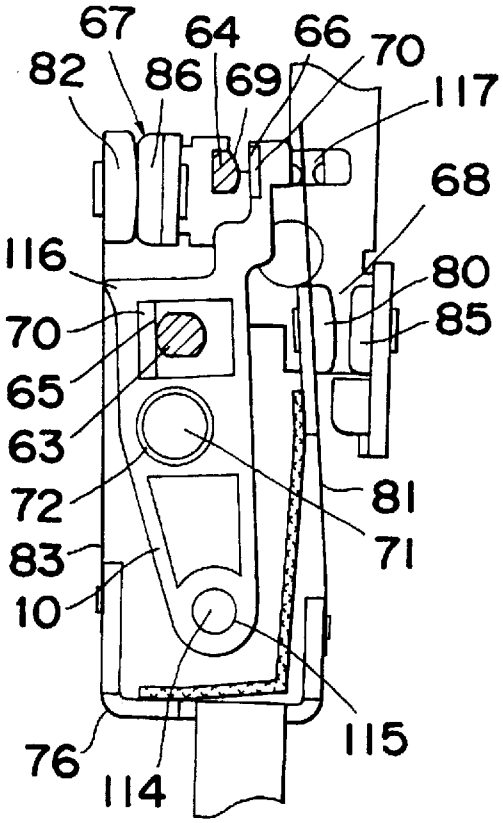
Figure 10A:
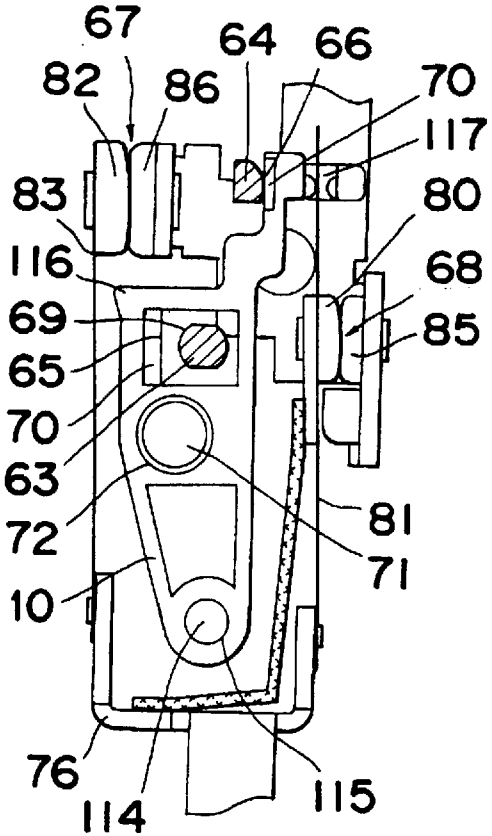

Starting from the condition shown in FIG. 10A, and when the U-shaped actuator frame 1 is magnetically driven to pivot from the right towards the left as viewed in FIG. 3A, the second actuator rod 64 integral with the actuator frame 1 tends to separate from the second engagement 66. However, since during the condition of FIG. 8C or 10A the main leaf spring 81 has accumulated the resilient force necessary to allow the main leaf spring 81 to restore to the original position, the driving piece 10 is, as biased by the main leaf spring 81, pivoted counterclockwise about the pivot pin 114 with the movable contact 80 consequently disengaged from the mating fixed contact 85 to thereby bring the main switch 68 in the OFF position as shown in FIG. 10B.

Shortly after separation of the second actuator rod 64 from the second engagement 66 during the counterclockwise pivot of the driving piece 10 as biased by the main leaf spring 81, the first actuator rod 63 integral with the actuator frame 1 is brought Into engagement with the first engagement 65 in the driving piece 10 to apply a pushing force to the driving piece 10 and, at the same time, the shoulder 116 of the driving piece 10 is brought into contact with the auxiliary leaf spring 83. Further continued pivot of the driving piece 10 in the counterclockwise direction about the pivot pin 114 results in disengagement of the arc contact 82 from the mating fixed contact 86 as shown in FIG. 10C and, consequently, the arc switch 67 is brought to the OFF position. During this further continued pivot of the driving piece 10, the resiliency of the main leaf spring 81 may be inactive and the main leaf spring 81 is pulled by the driving piece 10 through the catch 117 (For the details, see FIG. 17) with the movable contact 80 consequently separated further away from the mating fixed contact 85.

Figure 11:
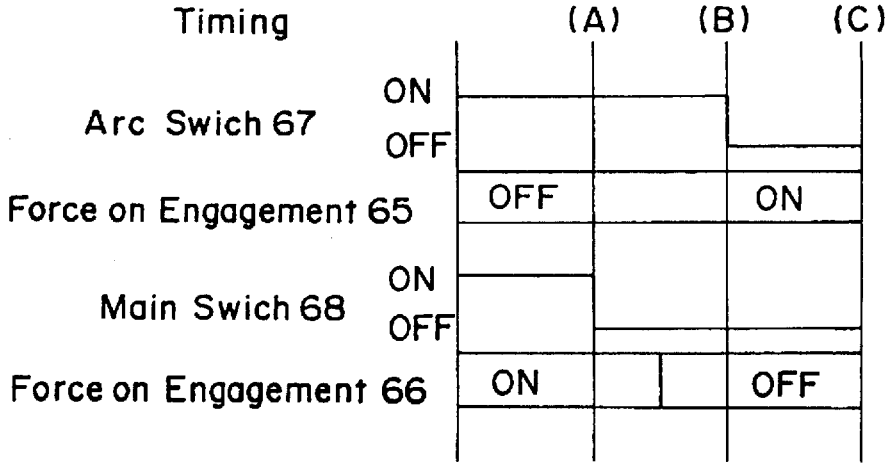
FIG. 11 is a timing chart showing the timings at which arc and main switches in the switch unit are operated in relation to pushing forces applied from the actuator unit during the set operation of the electromagnetic relay assembly.

As is the case with FIG. 9, In this timing chart of FIG. 9, legends (A), (B) and (C) used in the timing chart of FIG. 11 in connection with the timing correspond respectively to the conditions of FIGS. 10A, 10B and 10C. From FIGS. 10A to 10C and FIG. 11, it is clear that during the reset operation of the electromagnetic relay assembly according to the first embodiment of the present invention, the arc switch 67 having an excellent resistance to contact fusion is switched off a predetermined time after the main switch 68 having an excellent performance in contact resistance has been switched off. For this reason, generation of an arc which would occur the moment the main switch 68 is switched off can be suppressed.

It is to be noted that at least respective portions of the first and second actuator rods 63 and 64 integral with the U-shaped actuator frame 1 which are respectively engaged with the first and second engagement 65 and 66 in the driving piece 10 in the manners described hereinbefore are rounded at 63*a* and 64*a*, respectively, as best shown in FIGS. 8A to 8C and FIGS. 10A to 10C. Similarly, those portions of the first and second engagements 65 and 66 which are engaged respectively with the rounded contact faces 63*a* and 64*a* of the first and second actuator rods 63 and 64 are rounded or beveled at 65*a* and 66*a* so that when the first actuator rod 63 is brought into engagement with the first engagement 65 or when the second actuator rod 64 is brought into engagement with the second engagement 66, a substantially point contact can take place between the rounded contact face 63*a* or 64*a* of the first or second actuator rod 63 or 64 and the associated rounded or beveled edge 65*a* or 66*a* of the first or second engagement 65 or 66. The use of this point contact system between the first actuator rod 63 and the first engagement 65 and between the second actuator rod 64 and the second engagement 66 is particularly advantageous in that the friction which would take place therebetween can be drastically reduced. In any event, the use of the point contact system is particularly recommended where mutually engageable elements move in respective planes perpendicular to each other.

From the foregoing, it will readily be understood that since the U-shaped actuator frame 1 pivots about the common axis coaxial with the bearing pins 51 in a plane generally parallel to the longitudinal sense of the electromagnetic relay assembly and the driving piece 10 pivots about the pivot pin 114 in a plane substantially perpendicular to the plane of movement of the actuator frame 1, the stroke of angular movement of the driving piece 10 can be advantageously chosen as desired regardless of the stroke of angular movement of the U-shaped actuator frame 1.

Assuming that the single switch unit 8 has been coupled with the actuator unit 5 as hereinbefore described, at least one additional switch unit 8' can be coupled with the actuator unit 5 in a stacked fashion as shown in FIG. 2 and positioned on one side of the switch unit 8 opposite to the actuator unit 5. Where the two switch units 8 and 8' are to be employed to provide a double-pole, double-throw switch controlled by the common actuator unit 5, the driving piece 10 in the switch unit 8 and the driving piece 10 in the switch unit 8' have to be drivingly coupled with each other. For this purpose, the motion transmitting rod 71 is employed having one end press-fitted or bonded into the connecting hole 72 in the driving piece 10 of the switch unit 8 and the other end press-fitted or bonded into the connecting hole 72 in the driving piece 10 of the additional switch unit 8'; a substantially intermediate portion of said motion transmitting rod 71 extending loosely through a hole 119 defined in the intermediate partition wall 101. By so doing, the driving pieces 10 of the respective switch units 8 and 8' can be angularly moved in unison with each other.

Alternatively, the switch units 8 and 8' may have a different switch configuration so that those switch units can be selectively coupled with the actuator unit 5 one at a time depending on a particular application of the electromagnetic relay assembly. For example, although where the switch units 8 and 8' are of an identical construction, the switch assemblies 7 in the respective switch units 8 and 8' are operated in the same manner, that is, set or reset simultaneously, it is possible to configure the switch assembly 7 in one of the switch units 8 and 8' so as to be set or reset when the switch assembly 7 in the other of the switch units 8 and 8' to be reset or set, respectively.

Although it is not essential, the use of an insulator lid having a generally rectangular through-hole 120 defined therein for the passage of the motion transmitting rod 71 therethrough is preferred to close the open end of each of the switch units 8 and 8' remote from the actuator unit 5 as shown in FIG. 1B for safety purpose. Specifically, the insulator lid may be available in three types, two of which are shown respectively by 118 and 118' and the remaining type being a mere rectangular plate without the through-hole 120. The insulator lid shown by 118 is used where the two switch units 8 and 8' are connected together and, in this case, the insulator lid 118 serves as an insulator rather than a lid. On the other hand, the insulator lid shown by 118' is used, where the two or more switch units are connected together, to close the front open end of one of the switch units remotest from the actuator unit 5 and, for this purpose, the insulator plate 118' has pawls 13*a* engageable in the detent holes 14 when it is capped onto the front open end of the remotest switch unit. This insulator plate 118' may not have the rectangular opening defined therein. Nevertheless, the insulator plate 118 may have similar side pawls for engagement into the detent holes 14.

In any event, each of the holes 119 and 120 are so sized as to allow the motion transmitting rod 71 to be freely moved in a direction perpendicular to the longitudinal axis thereof without being disturbed.

As described above, according to the present invention, the actuator unit 5 including the actuator casing 4 accommodating therein the electromagnetic assembly 3 together with the U-shaped actuator frame 1 is relatively separable from at least the switch unit 8 including the switch casing 6 accommodating the switch assembly 7 therein. In other words, the electromagnetic assembly 3 and the U-shaped actuator frame 1 occupy a space separate from the space occupied by the switch assembly 7. Therefore, there is no possibility that a carbon powder which would be produced as a result of repeated switching on and off of a switch assembly may be deposited in a mechanism used to drive the switch assembly, consequently accompanied by increase in reliability of the electromagnetic relay assembly.

Figure 12:
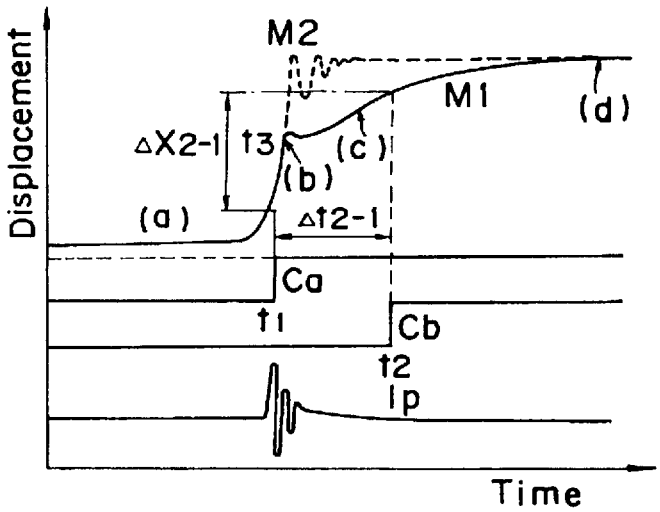
FIG. 12 is a graph showing the displacement of the actuator frame in the actuator unit and an operating characteristic of the damper.

The function of the damper 49 in relation to the movement of the U-shaped actuator frame 1 will now be discussed with reference to the graph of FIG. 12. In the graph of FIG. 12, a curve M1 shown by the solid line represents the displacement of the actuator frame 1 with passage of time when the damper 49 is employed, and a curve M2 shown by the broken line represents the displacement of the actuator frame 1 when no damper 49 is employed. Lines Ca and Cb represents timings of selective opening and closure of the arc switch 67 and the main switch 68, respectively, and a curve Ip represents the inrush current.

When the arc switch 67 having an excellent resistance to contact fusion is switched on at a timing t1 and the actuator leg 58*a* integral with the U-shaped actuator frame 1 subsequently abuts against the first chamber of the damper 49, the viscous fluid within the first chamber of the damper 49 flows into the second chamber of the damper 49 through the perforation. Since the perforation in the partition wall dividing the interior of the damper 49 into the first and second chambers serves as a flow control orifice, further movement of the actuator frame 1 towards the right as viewed in FIG. 3A with the actuator leg 58*a* held in contact with the first chamber of the damper 49 is slowed down and at the timing t2 the main switch 68 having an excellent performance in contact resistance is switched on. Accordingly, the time lag between the timing at which the arc switch 67 is switched on and the timing at which the main switch 68 is switched on, that is, the difference $\Delta t_{2-1}$ between the timings t1 and t2, is sufficiently so large that there is the possibility that the main switch 68 excellent in contact resistance may be switched on at the time the inrush current flows. For this reason, the possibility of contact fusion which would otherwise take place between the contacts 80 and 85 can be minimized.

Also, the fact that the movement of the actuator frame 1 is slowed down by the resistance of flow of the viscous fluid from the first chamber to the second chamber of the damper 49 results in reduction in level of sounds generated upon collision of one of the pole pieces 24 against the iron core 2 and, therefore, obnoxious sounds which would be generated when the electromagnetic relay assembly of the present invention is set or reset can advantageously be minimized. Moreover, since at the time the viscous fluid completely flows from the first chamber into the second chamber of the damper 49, the cushioning effect of the damper 49 is zeroed and, therefore, neither is the force of retention in the set position reduced, nor the operation at the time of resetting of the electromagnetic relay assembly will adversely affected.

Preferably, a surface area of each of the actuator legs 58*a* and 58*b* which is brought into contact with the first or second chamber of the damper 49 may be so inclined that the respective actuator leg 58*a* or 58*b* can contact the first or second chamber of the damper 49 from a transverse direction. By so doing, not only can a dynamic braking force be brought about by the damper 49, but also the damper 49 can transmit the braking force to the actuator frame 1.

An example of use of the electromagnetic relay assembly of the present invention in the remote-controlled monitoring system will now be described with reference to FIG. 13.

Figure 13:
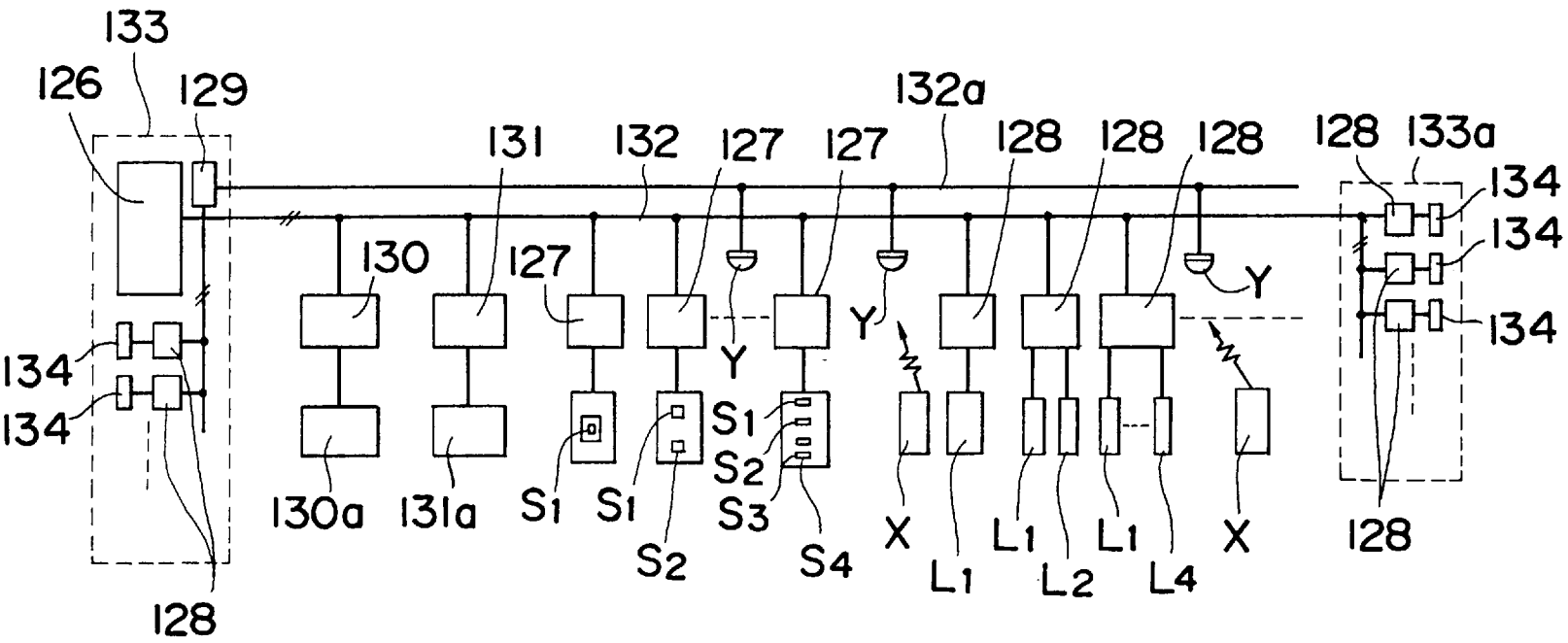
FIG. 13 is a schematic diagram showing a remote-controlled monitoring system in which the electromagnetic relay assembly of the present invention can be used.

The remote-controlled monitoring system shown in FIG. 13 comprises a central control device 126, a plurality of terminal devices 127 for monitoring switches S1 to S4 each having a particular address allocated thereto, terminal controllers 128 for controlling loads L1 to L4, wireless terminal repeaters 129, an external terminal interface 130 and a terminal selector switch 131, all electrically connected in a manner shown therein by means of a pair of signal lines 132.

Figure 14A:
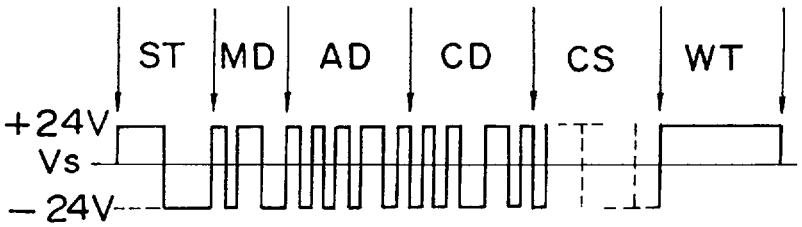
FIGS. 14A and 14B are diagrams showing waveforms of signals employed in the remote-controlled monitoring system of FIG. 13.
Figure 14B:
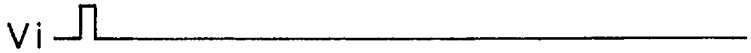

The central control device 126 generates a transmission signal Vs through the signal lines 132. The transmission signal Vs is of such a waveform as shown in FIG. 14A and is a multipolar (±24 volts) time-shared multiplexed signal including a start pulse ST indicative of the start of transmission of the signal, a mode data signal MD representative of a signal mode and a response wait signal WT for specifying a response timing for each of the terminal devices 127, 128, 129, 130 and 131. Data are transmitted on a pulse-width modulated basis.

In each of the terminal devices 127, 128, 129, 130 and 131, only when an address data contained in the transmission signal Vs received through the signal lines 132 matches with the particular address data of the terminal device, the control data contained in the transmission signal Vs can be down-loaded, but in synchronism with the response wait signal WT in the transmission signal Vs, a monitor data signal can be returned as a current mode signal.

The central control device 126 includes a dummy signal transmitting means for transmitting at all times a dummy transmission signal in which the mode data signal MD is rendered to be a dummy mode, and an interrupt processing means for accessing to interruption generating terminals 127, 129, 130 and 131 when an interrupt signal Vi of a waveform shown in FIG. 148 is received from the terminal monitor 127 or the wireless terminal repeaters 129, the external terminal interface 130 and the terminal selector switch 131.

The wireless terminal repeaters 129 serves to relay data of an optical wireless system comprising an optical wireless transmitter X, an optical wireless receiver Y and a wireless signal line 132*a*. The external terminal interface 130 is a terminal device for transmitting and receiving data to and from an external control device 130*a*, and the terminal selector switch 131 serves to transmit and receive data to and from a data input device 131*a* and also to collectively control the plural loads. A remote-controlled relay devices 134 of the present Invention for the control of the loads can be controlled by respective control outputs from the terminal controllers 128 and the terminal monitors 127 disposed within a panel board 133 or the external control device 130*a*.

In any event, the remote-controlled monitoring system shown in FIG. 13 is illustrative of the manner of use of the electromagnetic relay assembly embodying the present invention and does not constitute the subject matter of the present invention.

(Second Embodiment—FIGS. 15 to 23E)

The electromagnetic relay assembly according to the foregoing embodiment of the present invention is so designed and so configured that when the switch assembly 7 is to be closed, the arc switch 67 having an excellent resistance to contact fusion because of the use of the metallic material of a high melting point for the contacts 82 and 86) can be first switched on and the main switch 68 having an excellent performance in contact resistance because of the use of the metallic material of a low-melting point for the contacts 80 and 85) can be subsequently switched on, but when the switch assembly 7 is to be opened, the switching of the main switch 68 on is followed by the switching of the arc switch 67. However, where the contacts of the arc switch are made of the metallic material of a high-melting point such as tungsten having a high fusion performance are used to interrupt the flow of a relatively high electric current, a problem would occur.

The electromagnetic relay assembly which will now be described in connection with the second embodiment of the present invention is substantially similar to the electromagnetic relay assembly according to the foregoing embodiment except for the details of the auxiliary leaf spring 83 and also for the function of the driving piece 10. More specifically, in the electromagnetic relay assembly according to the second embodiment of the present invention, the auxiliary leaf spring 83 is employed in the form of a reversible bistable leaf spring.

Figure 15:
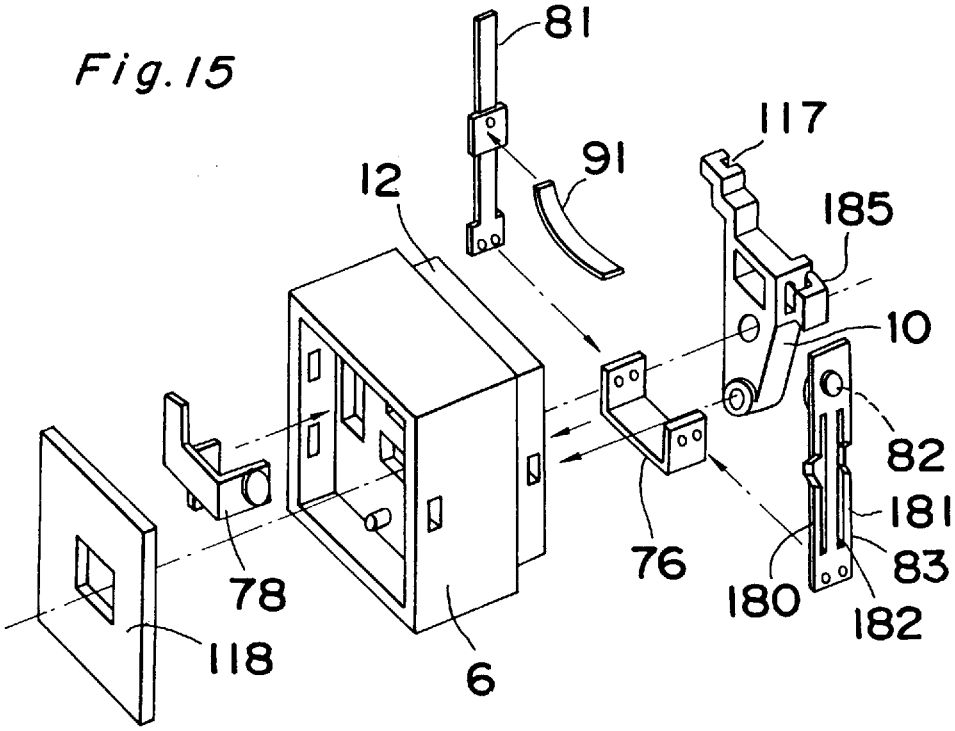
FIG. 15 is an exploded view of the switch unit according to a second preferred embodiment of the present invention.

Referring particularly to FIGS. 15, 16A and 16B, the auxiliary leaf spring 83 has a generally intermediate portion formed with two slits 83*a* extending parallel to each other in a direction lengthwise thereof so as to leave opposite side stripes 180 and 181 and an intermediate stripe 182 positioned intermediate between the side stripes 180 and 181. Generally intermediate portions of the respective side, stripes 180 and 181 are bent in a generally V- or U-shape at 184 in the same direction so that the intermediate stripe 182 can be bowed to compensate for the difference in length between the intermediate stripe 182 and the side stripes 180 and 181 which was brought about by bending those portions of the side stripes 180 and 181, to thereby complete the reversible bistable leaf spring.

The term "reversible bistable" hereinabove and hereinafter used is intended to means that the auxiliary leaf spring 83 in a free state can assume one of two states of equilibrium selectively when deflected in either direction by the application of an external force. This is possible because as the intermediate stripe 182 is forced to extend straight by the application of an external force in one direction substantially transverse to the intermediate stripe 182, stresses are built up in the bends 184 in the side stripes 180 and 181 with portions of the side stripes 180 and 181 on respective sides of the bends 184 being pulled inwardly towards each other and, consequently, the intermediate stripe 182 can be instantaneously deflected in a direction conforming to the direction of application of the external force thereto to lessen the stresses built up in the bends 184.

Considering that the auxiliary leaf spring 83 is rigidly secured at the lower end to one of the upstanding arms 89 of the movable contact terminal 76, the upper end of the auxiliary leaf spring 83 can be selectively snapped into one of two positions as the auxiliary leaf spring 83 assumes one of the two states of equilibrium selectively.

Where the auxiliary leaf spring 83 of the reversible bistable type such as shown in FIGS. 16A and 16B is employed, the driving piece 10 requires a slight modification. As best shown in FIG. 17, the driving piece 10' shown therein has an additional catch 185 formed integrally therewith for holding the auxiliary leaf spring 83 in a manner which will now be described. The catch 185 includes two drive protuberances 185*a* and 185*b* spaced from each other a distance substantially equal to or slightly greater than the thickness of the auxiliary leaf spring 83, particularly that of the intermediate stripe 182. The drive protuberance 185*a* is integral with the body of the driving piece 10', but the other drive protuberance 185*b* is carried by a finger member 185*c* formed integrally therewith and extending from the body of the driving piece 10' so as to bring the drive protuberance 185*b* in face-to-face relation with the drive protuberance 185*a*.

In an assembled condition as shown in FIGS. 22A to 22E and FIGS. 23A to 23E, the drive protuberances 185*a* and 185*b* of the catch 185 sandwich a substantially intermediate portion of the intermediate stripe 182 of the auxiliary leaf spring 83 while permitting the side stripes 180 and 181 to be clear from the driving piece 10' at all times regardless of the direction in which the side stripes 180 and 181 are deflected in unison with each other. Thus, it will readily be understood that when the driving piece 10' is pivoted counterclockwise about the pivot pin 114 the intermediate stripe 182 of the auxiliary leaf spring 83 is pushed leftwards as viewed in FIG. 16B by the drive protuberance 185*b* with the respective bends 184 in the side stripes 180 and 181 snapped to the right side of the intermediate stripe 182. In this condition, the upper end of the auxiliary leaf spring 83 is displaced to the right as viewed in FIG. 16B. However, when the driving piece 10' is pivoted clockwise about the pivot pin 114 the intermediate stripe 182 is pushed rightwards as shown in FIG. 16B by the drive protuberance 185*a* with the respective bends 184 in the side stripes 180 and 181 snapped to the left side of the intermediate stripe 182. In this condition, the upper end of the auxiliary leaf spring 83 is displaced to the left as shown in FIG. 16B.

In the example shown in FIG. 17, during assembly, and particularly when the driving piece 10' is to be installed inside the switch casing 6 after the auxiliary leaf spring 83 has been incorporated therein, care must be taken to avoid an interference of either one of the side stripes 185*a* and 185*b* with the drive protuberances 185*a* and 185*b* before the intermediate stripe 182 is snugly seated in between the drive protuberances 185*a* and 185*b*. This procedure appears to be cumbersome and time-consuming and, therefore, that portion of the intermediate stripe 182 may be rigidly coupled with a corresponding portion of the driving piece as shown In FIGS. 18A to 18C.

In the modification shown in FIGS. 18A to 18C, the catch 185 employed in the driving piece 10" includes a connecting projection 185*d* and, on the other hand, that portion of the intermediate stripe 182 of the auxiliary leaf spring 83 is formed with a connecting hole 186. The connecting projection 185*d* is adapted to be inserted through the connecting hole 186 as shown in FIG. 18B with its free end subsequently thermally fused to provide an anchor as shown in FIG. 18C so that the intermediate stripe 18*c* can be displaced together with movement of the driving piece 10".

Figure 19:
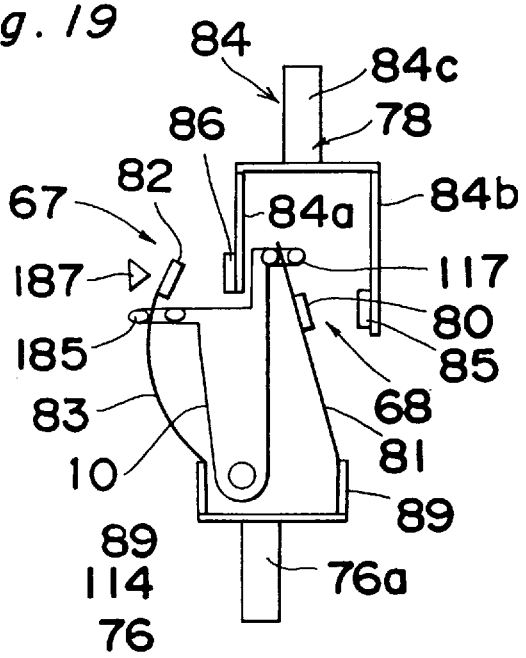
FIG. 19 is a schematic representation of the switch unit utilizing the auxiliary leaf sprig of the type shown in FIGS. 16A and 16B.

FIG. 15 illustrates the switch unit 8 employing the auxiliary leaf spring 83 shown in FIGS. 16A and 16B in combination with the driving piece 10' shown in FIG. 17. FIG. 19 is a schematic representation of such switch unit 8 in an assembled condition. In FIG. 19, reference numeral 187 represents a stopper engageable with the upper end of the auxiliary leaf spring 83, which stopper may be a part of the side wall of the switch casing 6. Hereinafter, the setting and resetting operations of the electromagnetic relay assembly according to the second embodiment of the present invention will be described with particular reference to FIGS. 22A to 22E and FIGS. 23A to 23E, respectively. It is however to be noted that since the operation of the actuator unit 5 has already been described in connection with the foregoing embodiment of the present Invention, reference thereto will not be reiterated for the sake of brevity.

Figure 22A:
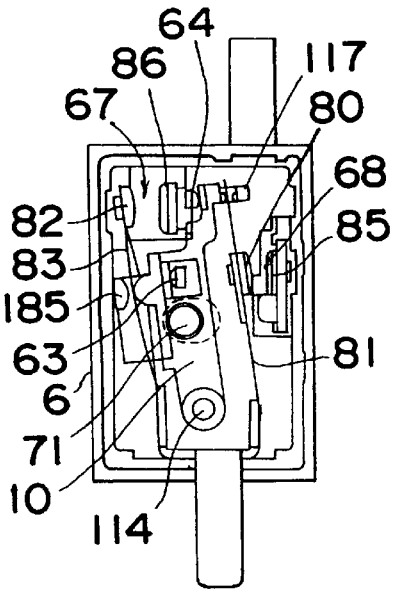
FIGS. 22A to 22E are schematic front elevational views of the switch unit of FIG. 18, showing the sequence of operation thereof during a setting of the electromagnetic relay assembly.
Figure 22B:
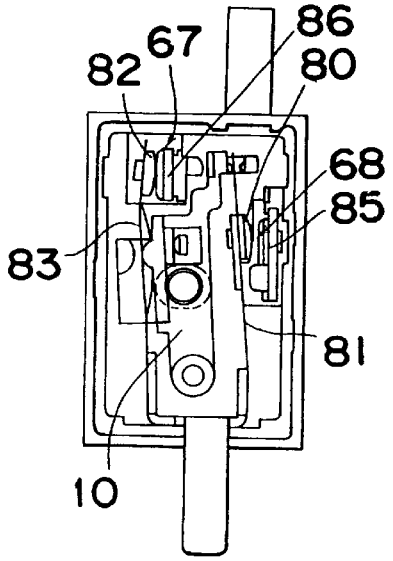
Figure 22C:
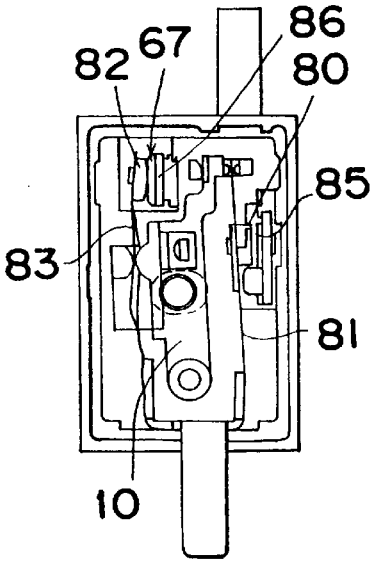
Figure 22D:
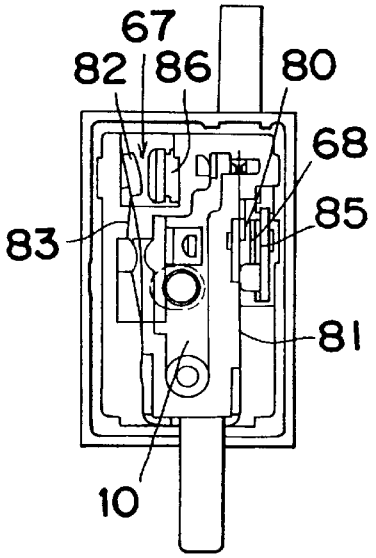
Figure 22E:
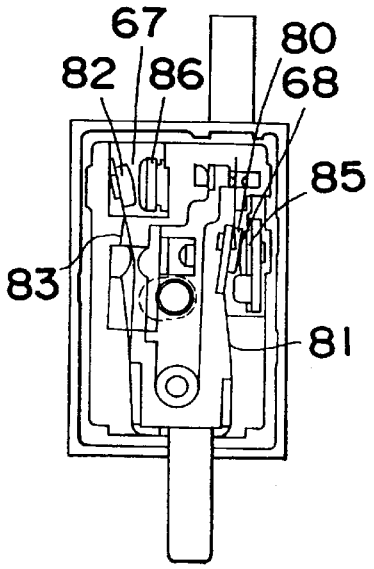

FIG. 22A illustrates a reset condition of the electromagnetic relay assembly in which both of the arc switch 67 and the main switch 68 are switched off, that is, held in the OFF position. Starting from this condition shown in FIG. 22A, and when the driving piece 10' is pivoted clockwise about the pivot pin 114 as a result of the actuator frame 1 having been pivoted to the right in the manner as hereinbefore described, the auxiliary leaf spring 83 is deflected as pulled by the catch 186 in a manner as shown in FIG. 22B with its upper end displaced rightwards as viewed therein and the arc switch 67 is consequently switched on. Further clockwise pivot of the driving piece 10' results in the main switch 68 being switched on as shown in FIG. 22C. However, immediately or shortly after the main switch 68 has been brought in the ON position as shown in FIG. 22C, the auxiliary leaf spring 83 having its upper end once displaced rightwards is snapped to deflect with its upper end displaced leftwards, resulting in switching the arc switch 67 off as shown in FIG. 22D. Thereafter, only the main switch 68 is kept in the ON position as shown in FIG. 22E.

Since as hereinabove described the main switch 68 is switched on subsequent to the arc switch 67 having been switched on, the possibility of contact fusion which would otherwise take place between the contacts 80 and 85 of the main switch 68 when the both are brought into contact with each other can be minimized.

Figure 23A:
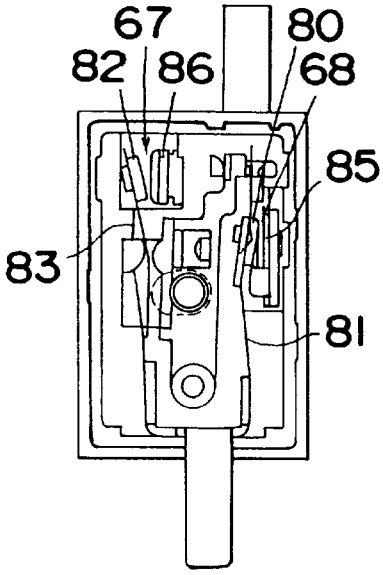
FIGS. 23A to 23E are schematic front elevational views of the switch unit of FIG. 19, showing the sequence of operation thereof during a resetting of the electromagnetic relay assembly.
Figure 23B:
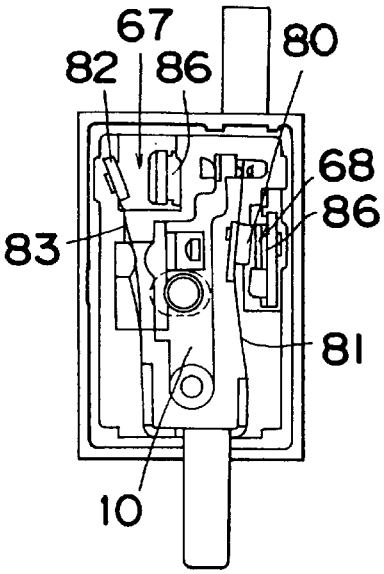
Figure 23C:
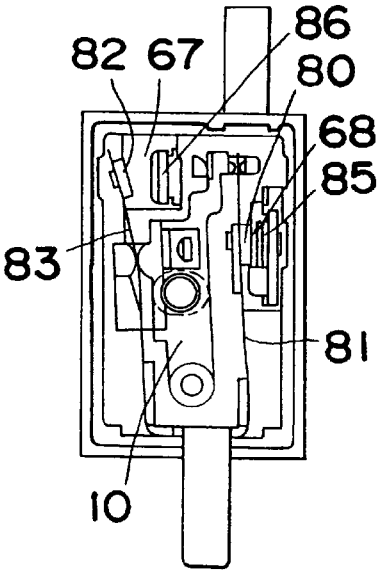
Figure 23D:
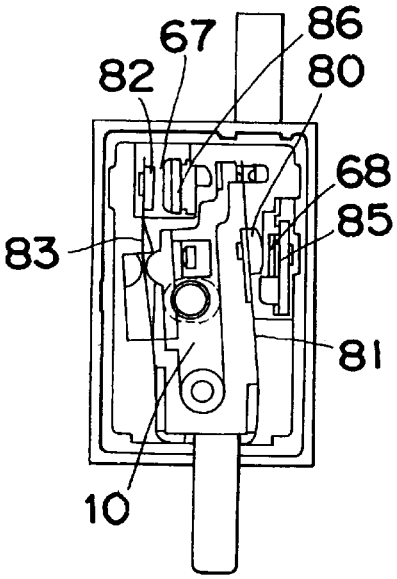
Figure 23E:
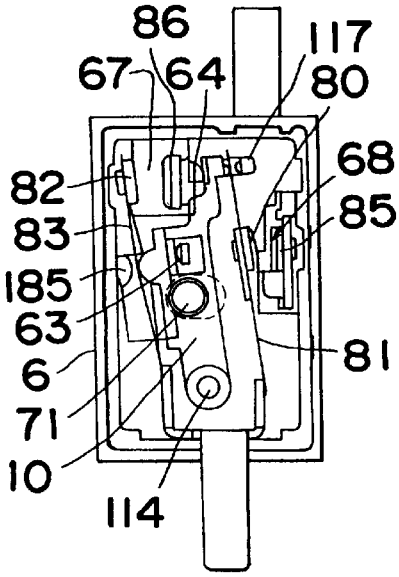

When it comes to the reset operation, FIG. 23A illustrates a set condition of the electromagnetic relay assembly. Starting from this condition, and when the driving piece 10' is pivoted counterclockwise about the pivot pin 114, the main switch 68 is switched off as shown in FIGS. 23B and 23. Since at this time the main switch 68 is switched off while the arc switch 67 is opened, the flow of the electric current through the main switch 68 can be effectively interrupted. Further counterclockwise pivot of the driving piece 10' results in the auxiliary leaf spring 83 being snapped to deflect as shown in FIG. 23D with the upper end thereof displaced rightwards. However, even though the upper end of the auxiliary leaf spring 83 is so displaced rightwards, the arc contact 82 carried thereby does not contact the fixed contact 86 and, consequently, at the completion of the counterclockwise pivot of the driving piece 10', both of the arc and main switches 67 and 68 are opened as shown in FIG. 23E to assume the reset condition.

The design and the structure shown In FIGS. 16A and 16B are particularly advantageous In configuring the auxiliary leaf spring 83 as a reversible bistable leaf spring discussed hereinabove along with minimization of variations in making the auxiliary leaf springs. According to the example shown in FIGS. 16A and 16B, mere formation of the slits 83*a* and 83*b* is substantially sufficient to form the reversible bistable leaf spring and, yet, this type of leaf spring would bring nothing that would place any other component parts under a stressed condition.

Figure 20:
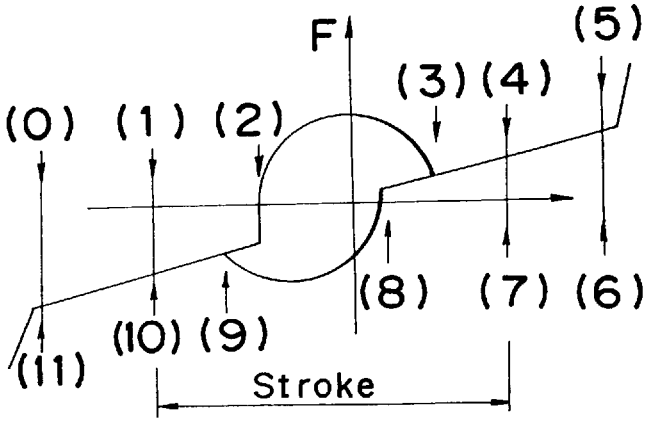
FIG. 20 illustrates an operating characteristic of the auxiliary leaf spring employed in the practice of the second embodiment of the present invention.
Figure 21:
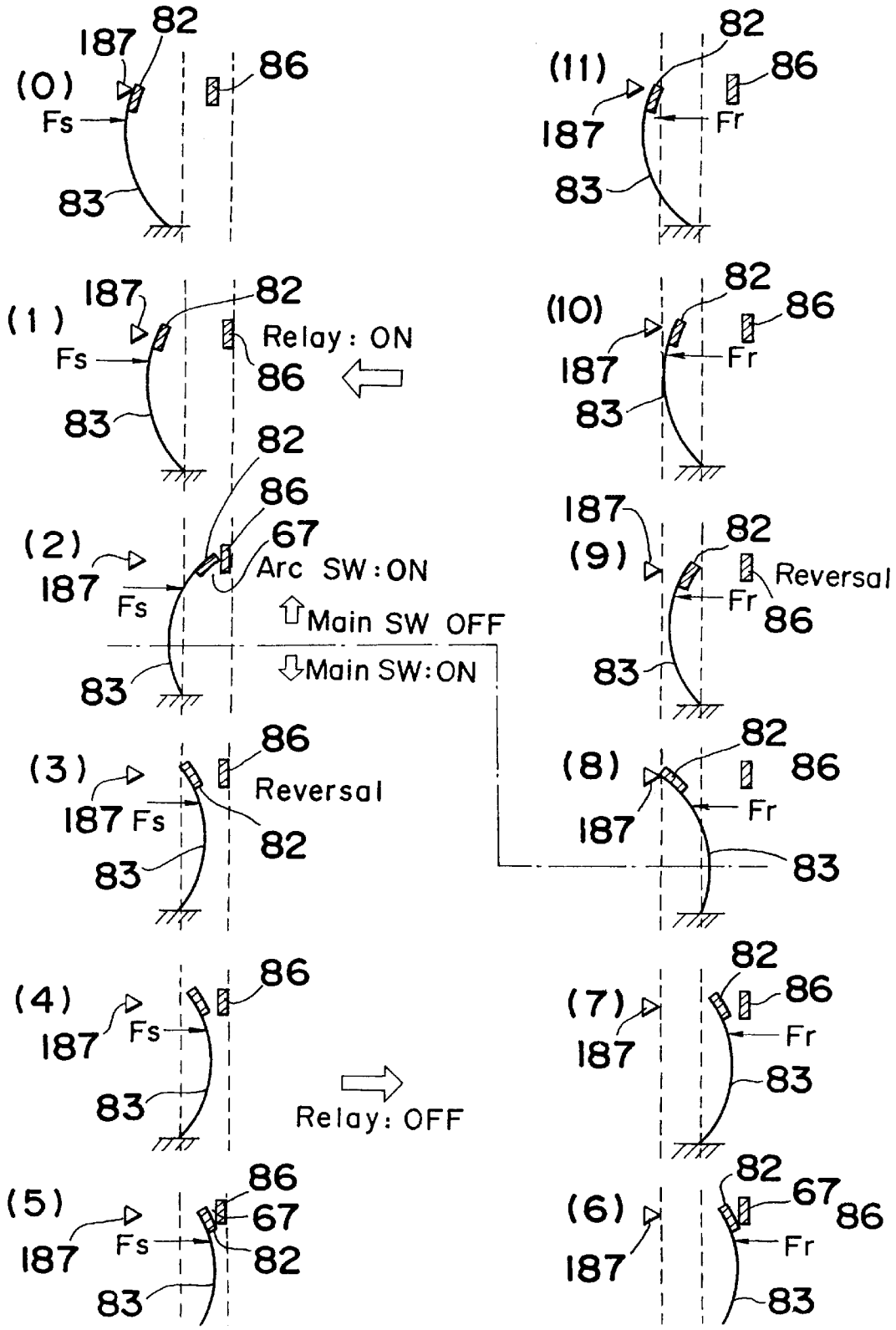
FIG. 21 illustrates the sequence of successive steps of reversible deflection of the auxiliary leaf spring, shown in FIGS. 16A and 16B, when the electromagnetic relay assembly is set and reset.

FIG. 20 illustrates an operating characteristic of the auxiliary leaf spring 83 employed in the practice of the second embodiment of the present invention, in which the axis of abscissa represents the stroke of reversible displacement of the auxiliary leaf spring 83 and the axis of ordinates represents the force produced by the auxiliary leaf spring 83. FIG. 21 illustrates the sequence of successive steps of reversible deflection of the auxiliary leaf spring 83 when the electromagnetic relay assembly is set and reset. Numerical legends (0) to (11) employed in FIG. 20 correspond respectively to steps (0) to (11) shown in FIG. 21. It is to be noted that steps (0) to (5) take place during the setting of the electromagnetic relay assembly and steps (6) to (11) take place during the resetting of the electromagnetic relay assembly.

Referring to FIGS. 20 and 21, step (0) illustrates a condition in which the auxiliary leaf spring 83 Is engaged with the stopper 187. Starting from this condition, and when the auxiliary leaf spring 83 is pushed rightwards by the driving piece 10' in a direction shown by the arrow Fs, the auxiliary leaf spring 83 deforms as shown at step (1). Further push of the auxiliary leaf spring 83 by means of the continued pivotal movement of the driving piece 10' results in switching of the arc switch 67 on as at step (2), followed by reversal of the auxiliary leaf spring 83, as at step (3), to deflect in a direction counter to that shown at steps (0) to (2), with the arc switch 67 switched off. Continued push results in deformation of the auxiliary leaf spring 83 in a manner shown at step (4), followed by the arc switch 67 being again switched on as at step (5).

Starting from the condition shown at step (5), when the auxiliary leaf spring 83 is pushed as at step (6) by a force Fr applied from the driving piece 10' and acting in a direction counter to the direction of the force Fs, the arc switch 67 is switched off as at step (7), followed by engagement of the auxiliary leaf spring 83 with the stopper 187 as at step (8). Further push of the auxiliary leaf spring 83 by the continued application of the force Fr results in reversal of the auxiliary leaf spring 83 as shown at step (9) so that the auxiliary leaf spring 83 subsequently deforms as shown at steps (10) and (11) without the arc switch 67 being switched off.

Figure 24:
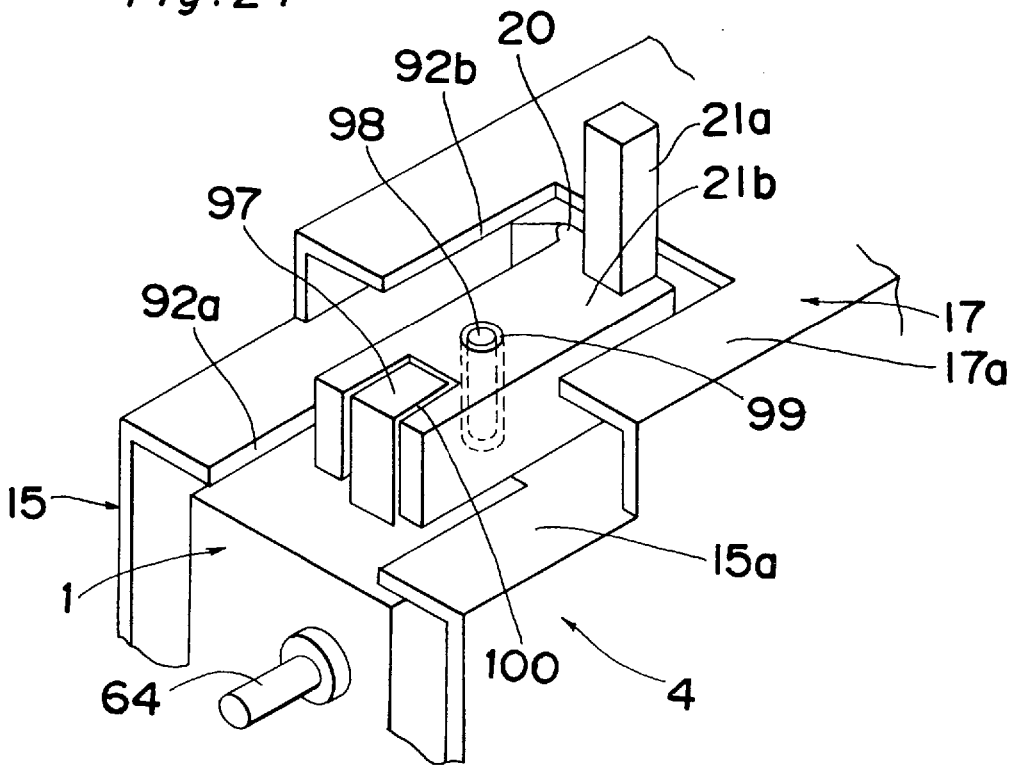
FIG. 24 is a schematic perspective view showing a modified manipulatable switching lever movably mounted on the movable actuator frame.

FIG. 24 illustrates a modified form of the manipulatable switching lever for selectively controlling switching elements accommodated within the auxiliary box 17 of the actuator unit 5. In the foregoing embodiments, the manipulatable switching lever 21 has been shown as formed integrally with the U-shaped actuator frame 1. However, in the modification shown in FIG. 24, a manipulatable switching lever 21*a* is separate from the actuator frame 1 and is drivingly coupled therewith through an intermediate member 21*b*. This intermediate member 21*b* is a generally elongated member formed at one end with the manipulatable switching lever 21*a*, with a connecting recess 100 at the opposite end, a generally intermediate portion thereof being formed with a bearing hole 99. On the other hand, the actuator frame 1 is formed with an engagement projection 97 engageable in the connecting recess 100 and also with a pivot pin 98 extending upwardly therefrom through the U-shaped cutout 92*a*, so that when the intermediate member 21*b* is mounted on the actuator frame 1, the pivot pin 98 can extend through the bearing hole 99 in the manipulatable switching lever 21*a* and, on the other hand, the engagement projection 97 is engaged in the connecting recess 100.

It will thus be understood that not only can the pivotal movement of the actuator frame 1 be transmitted to the manipulatable switching lever 21*a* through the intermediate member 21*b*, but also the movement of the manipulatable switching lever 21*b* effected by the application of a manual pushing force thereto results in a corresponding pivotal movement of the actuator frame 1.

From the foregoing full description of the preferred embodiments of the present invention, it has now become clear that since the switch unit 8 including the switch assembly 7 is a member separate from the actuator unit 5 including the electromagnetic assembly 3, the single actuator unit 5 can be selectively used with one or more of the switch units having the same and/or different switch specifications. Moreover, since the switch assembly 7 and the electromagnetic assembly 3 are accommodated in different and separate spaces, respectively, there is no possibility that carbon particles which would be produced as a result of repeated switching on and off of the switch assembly may contaminate the electromagnetic assembly 3 and, therefore, the reliability of the electromagnetic relay assembly as a whole can advantageously increased.

Although the present invention has been described in connection with the preferred embodiments thereof, it should be noted that various changes and modifications are apparent to those skilled in the art. For example, in describing the preferred embodiments of the present invention the switch assembly 7 in the or each switch unit 8 has been described and shown as comprising the main and auxiliary switches 68 and 67 although the switch assembly 7 serves as a single-pole switch for selectively opening and closing an electric circuit. The auxiliary switch 67 is utilized to minimize generation of arcs which tend to occur between contacts of the main switch 68 particularly where the load to be controlled requires a relatively high inrush current. However, in a broad aspect of the present invention, such auxiliary switch is not always essential and may therefore be dispensed with together with its related component parts or may be used for a different purpose, for example, for selectively opening and closing an electric circuit different from that controlled by the main switch.

Also, where a substantial distance is desired between the actuator unit 5 and one or more of the switch units, at least one dummy casing substantially identical in structure to the switch casing 6 may be employed together with the motion transmitting rod 71. This dummy casing should have no switch assembly incorporated therein and merely serves as a spacer between the actuator unit and the next adjacent switch unit to provide a distance therebetween.

Accordingly, such changes and modifications so far as encompassed by the appended claims are to be understood as included within the scope of the present invention.

What is claimed is:

1. An electromagnetic relay assembly which comprises:

an actuator unit comprising an actuator casing accommodating therein an electromagnetic assembly and a movable actuator frame magnetically attracted by the electromagnetic assembly to move between first and second positions;

at least one switch unit comprising a switch casing accommodating therein a switch assembly capable of selectively assuming one of an ON state in response to movement of the movable actuator frame from the first position to the second position and an OFF state in response to movement of the movable actuator frame from the second position to the first position;

a driving piece included in said switch unit, said driving piece being movable between first and second positions in response to movement of the movable actuator frame between the first and second positions, respectively, and wherein the movable actuator frame is drivingly coupled with said driving piece for movement in a plane generally perpendicular to the plane in which the movable actuator frame moves, and means included in part in the actuator casing and in part in the switch casing for detachably connecting the actuator unit and the switch unit together and also for drivingly coupling the movable actuator frame with the switch assembly.

2. The electromagnetic relay assembly as claimed in claim 1, wherein the switch unit is employed in a plural number and wherein said actuator unit is selectively coupled with any one of the plural switch units.

3. The electromagnetic relay assembly as claimed in claim 2, wherein the plural switch units are coupled with each other substantially in a stacked fashion and wherein the actuator unit is operatively coupled with one of the stacked switch units which is closest to the actuator unit.

4. The electromagnetic relay assembly as claimed in claim 1, further comprising a dummy casing identical in structure with the switch casing and interposed between the actuator unit and the switch unit.

5. The electromagnetic relay assembly as claimed in claim 1, wherein the switch casing includes a main box and an auxiliary box disposed atop the main box, said main box accommodating therein the switch assembly and said auxiliary box accommodating switching elements.

6. The electromagnetic relay assembly as claimed in claim 5, further comprising a manipulatable switching lever provided on the movable actuator frame for movement together therewith, said manipulatable switching lever having a portion used to control the switching elements.

7. The electromagnetic relay assembly as claimed in claim 1, further comprising a damper for providing a cushioning effect to the movement of the movable actuator frame from the first position to the second position and also from the second position to the first position.

8. The electromagnetic relay assembly as claimed in claim 7, wherein the damper is carried by the movable actuator frame by means of a bench formed integrally with a coil bobbin forming a part of the electromagnetic assembly.

9. The electromagnetic relay assembly as claimed in claim 7, wherein the damper is carried by the movable actuator frame by means of a bench secured to side yokes which form parts of the electromagnetic assembly.

10. The electromagnetic relay assembly as claimed in claim 1, wherein the electromagnetic assembly includes a generally U-shaped main yoke having first and second yoke arms and bearing pins mounted on the first and second yoke arms so as to extend coaxially outwardly in respective direction away from each other and wherein the movable actuator frame includes actuator arms each having a bearing hole defined therein and delimited by a plurality of lobes protruding radially inwardly, said movable actuator frame being movably mounted on the main yoke with the bearing pins extending through the corresponding bearing holes, said lobes in each of the yoke arms contacting the associated bearing pins in a multi-point support system, each of said actuator arms having a guide formed therein for facilitating mounting of the corresponding actuator arm onto the associated bearing pin to allow the bearing pin to engage in the associated bearing hole.

11. The electromagnetic relay assembly as claimed in claim 6, wherein the manipulatable switching lever is drivingly coupled with the actuator frame by means of an intermediate member movably connected at one end with the actuator frame and at the opposite end with the manipulatable switching lever, said intermediate member being pivotally mounted on the actuator frame.

12. The electromagnetic relay assembly as claimed in claim 1, wherein the actuator frame includes first and second actuator rods protruding therefrom in a direction counter to the electromagnetic assembly, and wherein said driving piece has first and second engagements with which the first and second actuator rods are engageable, respectively; wherein said switch assembly comprises a main switch capable of being switched on and off when the second actuator rod is engaged with and disengaged from the second engagement, respectively, and an auxiliary switch capable of being switched off and on when the first actuator rod is disengaged from and engaged with the second engagement, respectively; and wherein the timing at which the main switch is switched on is delayed a predetermined time from the timing at which the auxiliary switch is switched on and the timing at which the auxiliary switch is switched off is delayed a predetermined time from the timing at which the main switch is switched off.

13. The electromagnetic relay assembly as claimed in claim 1, wherein the driving piece is formed with a hole through which a motion transmitting rod loosely extends to transmit movement of the driving piece in one switch unit to the driving piece in the next adjacent switch unit.

14. The electromagnetic relay assembly as claimed in claim 1, wherein said switch assembly comprises a main switch having main movable and fixed contacts engageable with each other and an auxiliary switch having auxiliary movable and fixed contacts engageable with each other, said main movable and fixed contacts and said auxiliary movable and fixed contacts being disposed parallel to each other in an electric circuit of the switch assembly, said main and auxiliary movable contacts being driven in response to movement of the actuator frame; and wherein at least one of the auxiliary movable and fixed contacts of the auxiliary switch is made of a metallic material having a high melting point such as tungsten added with 1 to 80 wt % of an additive selected from the group consisting of Ag, C, Cu, In and Cd.

15. The electromagnetic relay assembly as claimed in claim, wherein said switch assembly comprises a main switch having main movable and fixed contacts engageable with each other and an auxiliary switch having auxiliary movable and fixed contacts engageable with each other, said main movable and fixed contacts and said auxiliary movable and fixed contacts being disposed parallel to each other in an electric circuit of the switch assembly, said main and auxiliary movable contacts being driven in response to movement of the actuator frame; and further comprising a reversible bistable leaf spring carrying the auxiliary movable-contact and capable of being selectively displaced to one of first and second reversible states whereby when the switch assembly is to be closed, said bistable leaf spring is displaced to the first reversible state to bring the auxiliary movable contact to engage the auxiliary fixed contact and then back to the second reversible state to separate the auxiliary movable contact from the auxiliary fixed contact after the main movable contact has been engaged with the main fixed contact, but when the switch assembly is to be opened, the bistable leaf spring is displaced to the second reversible state subsequent to the main movable contact having been separated from the main fixed contact.

16. The electromagnetic relay assembly as claimed in claim 15, wherein the reversible bistable leaf spring comprises a generally elongated leaf spring member having two parallel slits defined therein in a direction lengthwise thereof so as to leave side stripes and an intermediate stripe positioned between the side stripes, each of said side stripes being bent at at least one location to permit the leaf spring to accomplish a bistable reversion about the bends.

17. The electromagnetic relay assembly of claim 2, further comprising a dummy casing identical in structure to said switch casing, said dummy casing being interposed between said actuator unit and said switch unit.

18. The electromagnetic relay assembly as claimed in claim 1, wherein said switch assembly comprises a main switch hating main movable and fixed contacts engageable with each other and an auxiliary switch having auxiliary movable and fixed contacts engageable with each other, said main movable and fixed contacts and said auxiliary movable and fixed contacts being disposed parallel to each other in an electric circuit of the switch assembly, said main and auxiliary movable contacts being driven in response to movement of the actuator frame; and wherein at least one of tie auxiliary movable and fixed contacts of the auxiliary switch is made of a metallic material having a high melting point such as tungsten added with 1 to 80 wt % of an additive selected from the group consisting of Ag, C, CU, In and Cd.

19. The electromagnetic relay assembly as claimed in claim 1, wherein said switch assembly comprises a main switch having main movable and fixed contacts engageable with each other and an auxiliary switch having auxiliary movable and fixed contacts engageable with each other, said main movable and fixed contacts and said auxiliary movable and fixed contacts being disposed parallel to each other in an electric circuit of the switch assembly, said main and auxiliary movable contacts being driven in response to movement of the actuator frame; and further comprising a reversible bistable leaf spring carrying the auxiliary movable contact and capable of being selectively displaced to one of first and second reversible states whereby when the switch assembly is to be closed, said bistable leaf spring is displaced to the first reversible state to bring the auxiliary movable contact to engage the auxiliary fixed contact and then back to the second reversible state to separate the auxiliary movable contact from the auxiliary fixed contact after the main movable contact has been engaged with the main fixed contact, but when the switch assembly is to be opened, the bistable leaf spring is displaced to the second reversible state subsequent to the main movable contact having been separated from the main fixed contact.

20. An electromagnetic relay assembly comprising:

an actuator unit comprising an actuator casing accommodating therein an electromagnetic assembly and a movable actuator frame magnetically attracted by the electromagnetic assembly to move between first and second positions;

at least one switch unit comprising a switch casing accommodating therein a switch assembly capable of selectively assuming one of an ON state in response to movement of the movable actuator frame from the first position to the second position and an OFF state in response to movement of the movable actuator frame from the second position to the first position;

a driving piece included in said switch unit, said driving piece being movable between first and second positions in response to movement of the movable actuator frame between the first and second positions, respectively, the movable actuator frame being drivingly coupled with said driving piece for movement in a plane generally perpendicular to the plane in which the movable actuator frame moves, and coupling device included in part in the actuator casing and in part in the switch casing, said coupling device detachably connecting the actuator unit and the switch unit together and drivingly coupling the movable actuator frame with the switch assembly.

* * * * *

UNITED STATES PATENT AND TRADEMARK OFFICE

CERTIFICATE OF CORRECTION

PATENT NO. : 5,886,601

DATED : March 23, 1999

INVENTOR(S) : N. KITAMURA et al.

It is certified that error appears in the above-identified patent and that said Letters Patent is hereby corrected as shown below:

On the cover of the printed patent, at item [56], References Cited, Foreign Patent Documents, line 12, "81797926" should be ---8179726---.

On the cover of the printed patent, at item [57], Abstract, line 8, change "Includes" to ---includes---.

On the cover of the printed patent, at item [57], Abstract, line 18, change "In" to ---in---.

At column 26, line 55 (claim 15, line 2) of the printed patent, after "claim" insert ---1---.

At column 27, line 24 (claim 18, line 3) of the printed patent, "hating" should be ---having---.

At column 27, line 31 (claim 18, line 10) of the printed patent, "tie" should be ---the---.

Signed and Sealed this

Fourth Day of July, 2000

*Attest:*

*Attesting Officer*

Q. TODD DICKINSON

*Director of Patents and Trademarks*